US008659502B2

(12) United States Patent
Lam et al.

(10) Patent No.: US 8,659,502 B2
(45) Date of Patent: Feb. 25, 2014

(54) LENS FOR SCANNING ANGLE ENHANCEMENT OF PHASED ARRAY ANTENNAS

(75) Inventors: Tai Anh Lam, Kent, WA (US); Minas H. Tanielian, Bellevue, WA (US); David R. Smith, Durham, NC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/615,222

(22) Filed: Sep. 13, 2012

(65) Prior Publication Data

US 2014/0009350 A1 Jan. 9, 2014

Related U.S. Application Data

(60) Division of application No. 12/411,575, filed on Mar. 26, 2009, now Pat. No. 8,493,281, which is a continuation-in-part of application No. 12/046,940, filed on Mar. 12, 2008, now Pat. No. 8,130,171.

(51) Int. Cl.
*H01Q 15/02* (2006.01)
*H01Q 19/06* (2006.01)

(52) U.S. Cl.
USPC ..... 343/909; 343/753

(58) Field of Classification Search
USPC ..... 343/909, 911 R, 872, 753–755
See application file for complete search history.

(56) References Cited

U.S. PATENT DOCUMENTS

| | | | |
|---|---|---|---|
| 2,459,800 | A | 1/1949 | Esgate |
| 3,697,898 | A | 10/1972 | Blachier et al. |
| 3,877,014 | A | 4/1975 | Mailloux |
| 4,721,933 | A | 1/1988 | Schwartz et al. |
| 5,012,211 | A | 4/1991 | Young et al. |
| 5,283,587 | A | 2/1994 | Hirshfield et al. |
| 5,517,203 | A | 5/1996 | Fiedziuszko |
| 5,629,266 | A | 5/1997 | Lithgow et al. |
| 5,804,534 | A | 9/1998 | Zaki |
| 5,838,213 | A | 11/1998 | Huang |

(Continued)

FOREIGN PATENT DOCUMENTS

| | | |
|---|---|---|
| EP | 1496570 | 1/2005 |
| GB | 1402338 | 8/1975 |

(Continued)

OTHER PUBLICATIONS

Office Action, dated Oct. 3, 2012, regarding USPTO U.S. Appl. No. 12/689,003, 35 pages.

(Continued)

*Primary Examiner* — Hoang V Nguyen
(74) *Attorney, Agent, or Firm* — Yee & Associates, P.C.

(57) ABSTRACT

A method and apparatus are present for creating a negative index metamaterial lens for use with a phased array antenna. A design having a buckyball shape is created for the negative index metamaterial lens. The buckyball shape is capable of bending a beam generated by the phased array antenna to around 90 degrees from a vertical orientation to form an initial design. The initial design is modified to include discrete components to form a discrete design. Materials are selected for the discrete components. Negative index metamaterial unit cells are designed for the discrete components to form designed negative index metamaterial unit cells. The designed negative index metamaterial unit cells are fabricated to form fabricated designed negative index metamaterial unit cells. The negative index metamaterial lens is formed from the designed negative index metamaterial unit cells.

20 Claims, 18 Drawing Sheets

(56) References Cited

U.S. PATENT DOCUMENTS

| | | | | |
|---|---|---|---|---|
| 5,889,449 | A | 3/1999 | Fiedziuszko | |
| 5,905,472 | A | 5/1999 | Wolfson et al. | |
| 6,215,443 | B1 | 4/2001 | Komatsu et al. | |
| 6,281,769 | B1 | 8/2001 | Fiedziuszko | |
| 6,292,134 | B1 | 9/2001 | Bondyopadhyay | |
| 6,323,817 | B1 | 11/2001 | Ramanujam et al. | |
| 6,424,313 | B1 | 7/2002 | Navarro et al. | |
| 6,507,319 | B2 | 1/2003 | Sikina | |
| 6,603,374 | B1 | 8/2003 | Goertz et al. | |
| 6,670,930 | B2 | 12/2003 | Navarro | |
| 6,822,622 | B2 | 11/2004 | Crawford et al. | |
| 6,958,729 | B1 | 10/2005 | Metz | |
| 7,006,051 | B2 | 2/2006 | El-Mahdawy et al. | |
| 7,006,052 | B2 | 2/2006 | Delgado et al. | |
| 7,218,285 | B2 * | 5/2007 | Davis et al. | 343/754 |
| 7,463,109 | B2 | 12/2008 | Iio | |
| 7,538,946 | B2 | 5/2009 | Smith et al. | |
| 7,714,782 | B2 | 5/2010 | Davis et al. | |
| 7,724,180 | B2 | 5/2010 | Yonak et al. | |
| 7,855,691 | B2 * | 12/2010 | Yonak et al. | 343/755 |
| 7,928,900 | B2 | 4/2011 | Fuller | |
| 8,130,170 | B2 | 3/2012 | Nakahata et al. | |
| 8,130,171 | B2 | 3/2012 | Lam et al. | |
| 8,164,531 | B2 | 4/2012 | Lier | |
| 8,294,538 | B2 | 10/2012 | Ueda | |
| 2003/0227350 | A1 | 12/2003 | Abdelmonem | |
| 2005/0116874 | A1 | 6/2005 | El-Mahdawy et al. | |
| 2005/0225492 | A1 | 10/2005 | Metz | |
| 2006/0255875 | A1 | 11/2006 | Iio | |
| 2007/0285315 | A1 | 12/2007 | Davis et al. | |
| 2008/0165079 | A1 | 7/2008 | Smith et al. | |
| 2009/0289863 | A1 | 11/2009 | Lier | |
| 2010/0060388 | A1 | 3/2010 | Ueda | |
| 2010/0079354 | A1 | 4/2010 | Lam et al. | |
| 2010/0104823 | A1 | 4/2010 | Hyde et al. | |
| 2010/0200736 | A1 * | 8/2010 | Laycock et al. | 250/227.2 |
| 2010/0277398 | A1 | 11/2010 | Lam et al. | |
| 2010/0328175 | A1 | 12/2010 | Lam et al. | |
| 2011/0115684 | A1 | 5/2011 | Greegor et al. | |
| 2012/0086463 | A1 | 4/2012 | Boybay et al. | |
| 2012/0274525 | A1 | 11/2012 | Lam et al. | |

FOREIGN PATENT DOCUMENTS

| | | |
|---|---|---|
| WO | WO9812767 | 3/1998 |
| WO | WO2005093905 | 10/2005 |
| WO | WO2006023195 | 3/2006 |
| WO | WO2009148645 | 12/2009 |
| WO | WO2010144170 | 12/2010 |
| WO | WO2011062719 | 5/2011 |

OTHER PUBLICATIONS

Final Office Action, dated Aug. 1, 2012, regarding USPTO U.S. Appl. No. 12/491,554, 10 pages.
Office Action, dated Dec. 5, 2012, regarding USPTO U.S. Appl. No. 12/491,554, 14 pages.
Notice of Allowance, dated Nov. 30, 2012, regarding USPTO U.S. Appl. No. 12/621,957, 11 pages.
Lam et al, U.S. Appl. No. 12/689,003, "Steering Radio Frequency Beams Using Negative Index Metamaterial Lenses," Jan. 18, 2010, 76 Pages.
USPTO final office action dated Mar. 14, 2012 regarding U.S. Appl. No. 12/491,554, 13 Pages.
USPTO notice of allowance dated Mar. 7, 2012 regarding U.S. Appl. No. 12/411,575, 21 Pages.
USPTO restriction requirement dated Sep. 9, 2011 regarding U.S. Appl. No. 12/411,575, 5 Pages.
Response to restriction requirement dated Oct. 11, 2011 regarding U.S. Appl. No. 12/411,575, 7 Pages.
Amendment filed with RCE dated Sep. 26, 2011 regarding U.S. Appl. No. 12/046,940, 13 Pages.
USPTO non-final office action dated Nov. 10, 2010 regarding U.S. Appl. No. 12/046,940, 14 Pages.
USPTO notice of allowance dated Oct. 11, 2011 regarding U.S. Appl. No. 12/046,940, 16 Pages.
USPTO notice of allowance dated Jul. 7, 2011 regarding U.S. Appl. No. 12/046,940, 15 Pages.
Response to office action dated Jan. 13, 2011 regarding U.S. Appl. No. 12/046,940, 10 Pages.
USPTO final office action dated May 22, 2012 regarding U.S. Appl. No. 12/621,957, 29 Pages.
Bahrami et al., "Using Complementary split ring resonators to design bandpass waveguide filters", 2007 Asia-Pacific Microwave Conference, IEEE Piscataway, NJ, 2008, pp. 2341-2344.
Bilotti et al., "Theoretical and experimental analysis of magnetic inclusionsfor the realization of metamaterials at different frequencies", Microwave Symposium 2007 IEEE/MTT-S International, IEEE, Jun. 1, 2007, pp. 1835-1838.
Dong et al., "A Fast Ray-Trading Method for Microstrip Rotman Lens Analysis", Proceedings of 29th General Assembly of the International Union of Radio Science, Chicago IL, Aug. 2008, pp. 1-4.
Fuchs et al., "Design Optimization of Multishell Luneburg Lenses", IEEE Transactions on Antennas and Propagation, vol. 55, No. 2, Feb. 2007, pp. 283-289.
Greegor et al., "Microwave focusing and beam collimation using negative index of refraction lenses", IET Microw. Antennas Propag., vol. 1, Issue 1, Feb. 2007, pp. 108-115.
Gutman, "Modified Luneberg Lens" Journal of Applied Physics, vol. 25, No. 7, Jul. 1954, pp. 855-859.
Hunter et al., "Microwave Filters—Applications and Technology," IEEE Transactions on Microwave Theory and Techniques, vol. 50, No. 3, pp. 794,805, Mar. 2002 (abstract).
Jitha et al., "SRR loaded waveguide band rejection filter with adjustable bandwidth", Microwave and Optical Technology Letters, Wiley USA, vol. 48, No. 7, Jul. 2006, pp. 1427-1429.
Lam et al., "Experimental observation of the electric coupling effect in split ring resonators and the prevention", Physica Status Solidi a Wiley-VCH Verlag GMBH Germany, vol. 204, No. 12, Dec. 2007, pp. 3975-3978.
Lam et al., "Negative Index Metamaterial Lens for the Scanning Angle Enhancement of Phased-Array Antennas", Zouhdi et al. (eds.), Metamaterials and Plasmonics: Fundamentals, Modelling, Applications, The NATO Science for Peace and Security Programme, Springer Science + Business Media B.V., Jan. 2009, pp. 121-138.
Mosallaei, Nonuniform Luneberg and Two-Shell Lens Antennas: Radiation Characteristics and Design Optimization, IEEE Transactions on Antennas and Propogation, Jan. 2001, vol. 49, Issue 1, pp. 60-69.
Ortiz et al., "Complementary split-ring resonator for compact waveguide filter design", Microwave and Optical Technology Letters, Wiley IUSA, vol. 46, No. 1, Jul. 5, 2005, pp. 88-92.
Parazzoli et al., "Eikonal equation for a general anisotropic or chiral medium: application to a negative-graded index-of-refraction lens with an anisotropic material", Journal of Optical Society of America, vol. 23, No. 3, Mar. 2006, pp. 439-450.
Parazzoli et al., "Experimental Verification and Simulation of Negative Index of Refraction Using Snell's Law," Physical Review Letters, vol. 90, No. 10, Mar. 2003, pp. 1-4.
Pendry et al., "The Quest for the Superlens", Jul. 2006, retrieved Dec. 14, 2010 http://www.cmth.ph.ic.ac.uk/photonics/Newphotonics/pdf/sciam-pendry-4a.pdf.
Penney et al., "Broad Band Rotman Lens Simulations in FDTD", IEEE, Jul. 2005, pp. 51-54.
Rahm et al., "Design of electromagnetic cloaks and concentrators using form-invariant coordinate transformations of Maxwell's equations",Photonics and Nanostructures—Fundaments and Applications, vol. 6, Issue 1, Apr. 2008, pp. 87-95.
Rausch et al., "Rotman Lens Design Issues", 2005 IEEE Antennas and Propagation Society International Symposium, vol. 2B, Jul. 2005, pp. 35-38.
Rotman et al., "Wide-Angel Microwave Lens for Line Source Applications", IEEE Transactions on Antennas and Propagation, Nov. 1963, pp. 623-632.
Schoenlinner et al., "Wide-Scan Spherical-Lens Antennas for Automotive Radars," IEEE Transaction on Microwave Theory and Technique, Sep. 2002, vol. 50, Issue 9, pp. 2166-2175.

(56) References Cited

OTHER PUBLICATIONS

Sanford, "A Luneberg-Lens Update," editor H. Schrank, Antella Designer's Notebook, IEEE Antennas and Progation Magazine, vol. 37, Issue 1, Feb. 1995, pp. 76-79.
Simon "Analysis and Synthesis of Rotman Lenses," 22nd AIAA International Communications Satellite Systems Conference & Exhibit 2004, Mary 2004, 11 Pages.
Smith et al., "Gradient Index Metamaterials," Physical Review, edition 71, Mar. 2005, pp. 1-6.
Sparks et al., "Eight Beam Prototype Fiber Optic Rotman Lens", Nov. 1999 IEEE MW'99 Digest, pp. 283-286.
Wahab et al., "An investigation of square split-ring resonator as antenna operating at Terahertz frequency", Applied Electromagnetics, 2007, Asia Pacific Conference on, IEEE Piscataway NH, Dec. 4, 2007, pp. 1-6.
Xu et al., "Report on steerable antenna architectures and critical RF circuits performance", FP6-IST-2003-506745 Capanina, Information Society Technologies, Nov. 2006, pp. 1-85.
PCT search report dated Dec. 30, 2010 regarding application PCT/US2010/028364, filed Mar. 23, 2010, applicant's, applicant The Boeing Company, 14 Pages.
PCT search report dated Feb. 2, 2011 regarding application PCT/US2010053247, filed Oct. 19, 2010, applicant's, applicant The Boeing Company 15 Pages.
PCT search report dated Feb. 24, 2010 regarding application PCT/US2009/035072, filed Feb. 25, 2009, applicant's, applicant The Boeing Company, 3 Pages.
Notice of Allowance, dated Mar. 15, 2013, regarding USPTO U.S. Appl. No. 12/411,575, 20 pages.
Notice of Allowance, dated Mar. 13, 2013, regarding USPTO U.S. Appl. No. 12/689,003, 12 pages.

* cited by examiner

1700
| SIZE (mm) | CELL |
|---|---|
| d | 1.900 |
| w | 0.200 |
| wc | 0.160 |
| we | 0.155 |
| g | 0.200 |
| gc | 0.320 |
| L | 0.395 |
*FIG. 17*
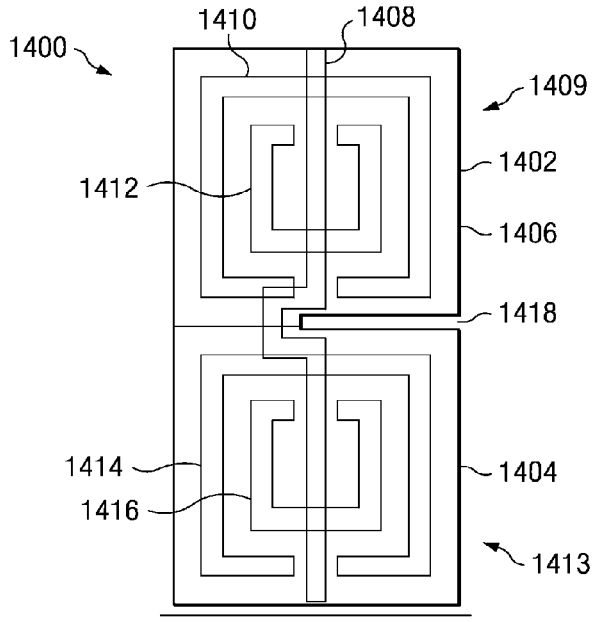
*FIG. 14*
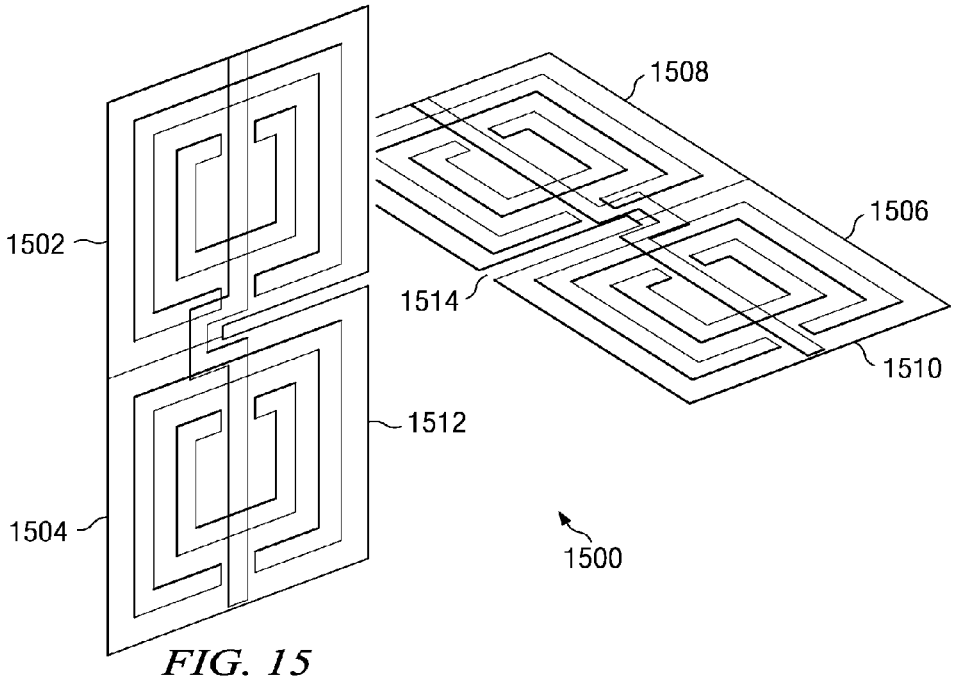
*FIG. 15*

LENS FOR SCANNING ANGLE ENHANCEMENT OF PHASED ARRAY ANTENNAS

RELATED APPLICATION

This application is a divisional of U.S. application Ser. No. 12/411,575, entitled "Lens for Scanning Angle Enhancement of Phased Array Antennas," filed Mar. 26, 2009, status Pending, which is a Continuation-in-Part of U.S. application Ser. No. 12/046,940, entitled "Lens for Scanning Angle Enhancement of Phased Array Antennas," filed Mar. 12, 2008, status Issued, Mar. 6, 2012 as U.S. Pat. No. 8,130,171 both of which are hereby incorporated herein by reference.

GOVERNMENT LICENSE RIGHTS

This invention was made with Government support under contract number HR0011-05-C-0068, awarded by the United States Defense Advanced Research Projects Agency. The Government has certain rights in this invention.

BACKGROUND INFORMATION

1. Field

The present disclosure relates generally to lenses and in particular to lenses for use with phased array antennas. Still more particularly, the present disclosure relates to a method and apparatus for a negative index metamaterial lens for scanning angle enhancement of phased array antennas.

2. Background

Phased array antennas have many uses. For example, phased array antennas may be used in broadcasting amplitude modulated and frequency modulated signals for various radio stations. As another example, phased array antennas are commonly used with seagoing vessels, such as warships. Phased array antennas allow a warship to use one radar system for surface detection and tracking, air detection and tracking, and missile uplink capabilities. Further, phased array antennas may be used to control missiles during the course of the missile's flight.

Phased array antennas also are commonly used to provide communications between various vehicles. Phased array antennas also are used in communications with spacecraft. As another example, the phased array antenna may be used on a moving vehicle or seagoing vessel to communicate with an aircraft.

The elements in a phased array antenna may emit radio frequency signals to form a beam that can be steered through different angles. The beam may be emitted normal to the surface of the elements radiating the radio frequency signals. Through controlling the manner in which the signals are emitted, the direction may be changed. The changing of the direction is also referred to as steering. For example, many phased array antennas may be controlled to direct a beam at an angle of around 60 degrees from a normal direction from the arrays in the antenna. Depending on the usage, ability, or capability to direct the beam at a higher angle, such as, for example, around 90 degrees, may be desirable.

Some currently used systems may employ a mechanically steered antenna to achieve greater angles. In other words, the antenna unit may be physically moved or tilted to increase the angle at which a beam may be steered. These mechanical systems may move the entire antenna. This type of mechanical system may involve a platform that may tilt the array in the desired direction. These types of mechanical systems, however, move the array at a rate that may be slower than desired to provide a communications link.

Therefore, it would be advantageous to have a method and apparatus to overcome the problems described above.

SUMMARY

In one advantageous embodiment, a method is present for creating a negative index metamaterial lens for use with a phased array antenna. A design having a buckyball shape is created for the negative index metamaterial lens. The buckyball shape is capable of bending a beam generated by the phased array antenna to around 90 degrees from a vertical orientation to form an initial design. The initial design is modified to include discrete components to form a discrete design. Materials are selected for the discrete components. Negative index metamaterial unit cells are designed for the discrete components to form designed negative index metamaterial unit cells. The designed negative index metamaterial unit cells are fabricated to form fabricated designed negative index metamaterial unit cells. The negative index metamaterial lens is formed from the designed negative index metamaterial unit cells.

In another advantageous embodiment, a method is present for creating a lens for a phased array antenna. A buckyball shell having an average radius of around an inner radius of a lens design is selected using a first ellipse and a second ellipse. The buckyball shell has a plurality of faces, wherein the plurality of faces has a plurality of points. A thickness is selected for the plurality of faces. A conformal transformation from the lens design to each point in the plurality of points is performed to form a lens design.

In yet another advantageous embodiment, a method is present for creating a negative index metamaterial lens for a phased array antenna. An array of radio frequency emitters capable of emitting a beam that is steerable to a first angle relative to a vertical orientation is identified. A negative index metamaterial lens having a buckyball shape and capable of bending the beam emitted by the array of radio frequency emitters to a desired angle relative to the vertical orientation is formed.

In yet another advantageous embodiment, an apparatus comprises a negative index metamaterial lens and an array. The buckyball shape is capable of bending a radio frequency beam to a selected angle relative to a normal vector. The array is capable of emitting the radio frequency beam.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

FIG. 14 is a diagram illustrating two unit cells in accordance with an advantageous embodiment;

FIG. 15 is an illustration of unit cells positioned for assembly in accordance with an advantageous embodiment;

FIG. 17 is a table illustrating dimensions for a cell in accordance with an advantageous embodiment;

DETAILED DESCRIPTION

Figure 1:
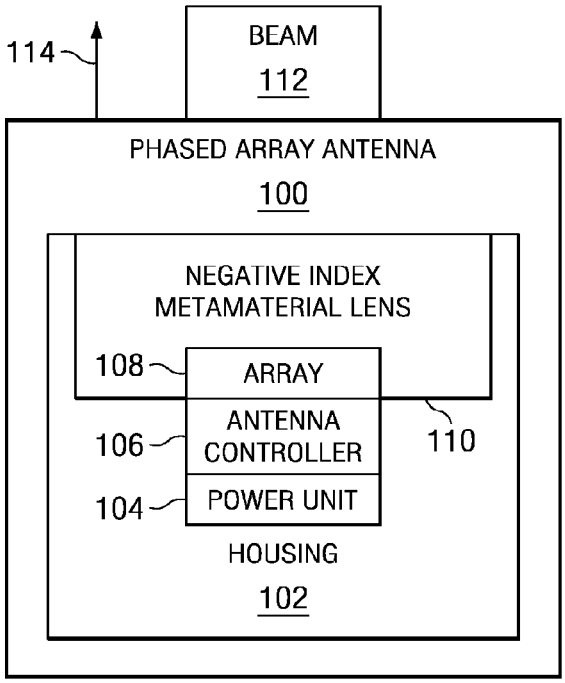
FIG. 1 is a block diagram illustrating a phased array antenna in which an advantageous embodiment may be implemented.

With reference now to the figures and in particular with reference to FIG. 1, a block diagram illustrating a phased array antenna is depicted in accordance with an advantageous embodiment. In this example, phased array antenna 100 includes housing 102, power unit 104, antenna controller 106, array 108, and negative index metamaterial lens 110. Housing 102 is the physical structure containing different elements of phased array antenna 100. Power unit 104 provides power in the form of voltages and currents needed by phased array antenna 100 to operate. Antenna controller 106 provides a control system to control the emission of microwave signals by array 108. These microwave signals are radio frequency emissions that may be emitted by array 108.

Array 108 is an array of microwave transmitters. Each of these microwave transmitters may also be referred to as an element or radiator. In these examples, each of the transmitters within array 108 is connected to antenna controller 106. Antenna controller 106 controls the emission of radio frequency signals in a manner that generates beam 112. In particular, antenna controller 106 may control the phase and timing of the transmitted signal from each of the transmitters in array 108.

In other words, each of the elements within array 108 may transmit signals using a different phase and timing with respect to other transmitters in array 108. The combined individual radiated signals form the constructive and destructive interference patterns of the array in the manner that beam 112 may be directed at different angles from array 108.

In these examples, beam 112 may radiate in a number of different directions relative to normal vector 114. Normal vector 114 is in a direction normal to a plane on which array 108 is formed. Typically, antenna controller 106 may control or steer beam 112 in a fashion that beam 112 radiates either at zero degrees with respect to normal vector 114 up to around 60 degrees from normal vector 114.

In the advantageous embodiments, negative index metamaterial lens 110 provides the capability to increase the angle from normal vector 114 past the typically available vector around 60 degrees. In the different advantageous embodiments, negative index metamaterial lens 110 bends beam 112 to an angle of around 90 degrees from normal vector 114. This bending increases the angle from which beam 112 may be steered.

Negative index metamaterial lens 110 allows for this type of directing of beam 112 without requiring moving mechanical components as in currently used solutions. A metamaterial is a material that gains its properties from the structure of the material rather than directly from its composition. A metamaterial may be distinguished from other composite materials based on unusual properties that may be present in the metamaterial.

For example, the metamaterial may have a structure with a negative refractive index. This type of property is not found in naturally occurring materials. The refractive index is a measure of how the speed of light or other waves are reduced in a medium.

Further, a metamaterial also may be designed to have negative values for permittivity and permeability. Permittivity is a physical quantity that describes how an electrical field affects and is affected by a dielectric medium. Permeability is a degree of magnetism of a material that responds linearly to an applied magnetic field. In the different advantageous embodiments, negative index metamaterial lens 110 is a lens that is formed with a metamaterial that has a negative index of refraction. This lens may also include other properties or attributes to bend beam 112.

The different advantageous embodiments recognize that a lens using a positive index also may be employed within phased array antenna 100. The different advantageous embodiments, however, recognize that this type of lens results in a structure that may be too large with respect to housing 102. This type of lens may protrude from housing 102 and may result in aerodynamic concerns, depending on the type of implementation. As a result, the different advantageous embodiments use a negative index metamaterial to form the lens used in phased array antenna 100.

Figure 2:
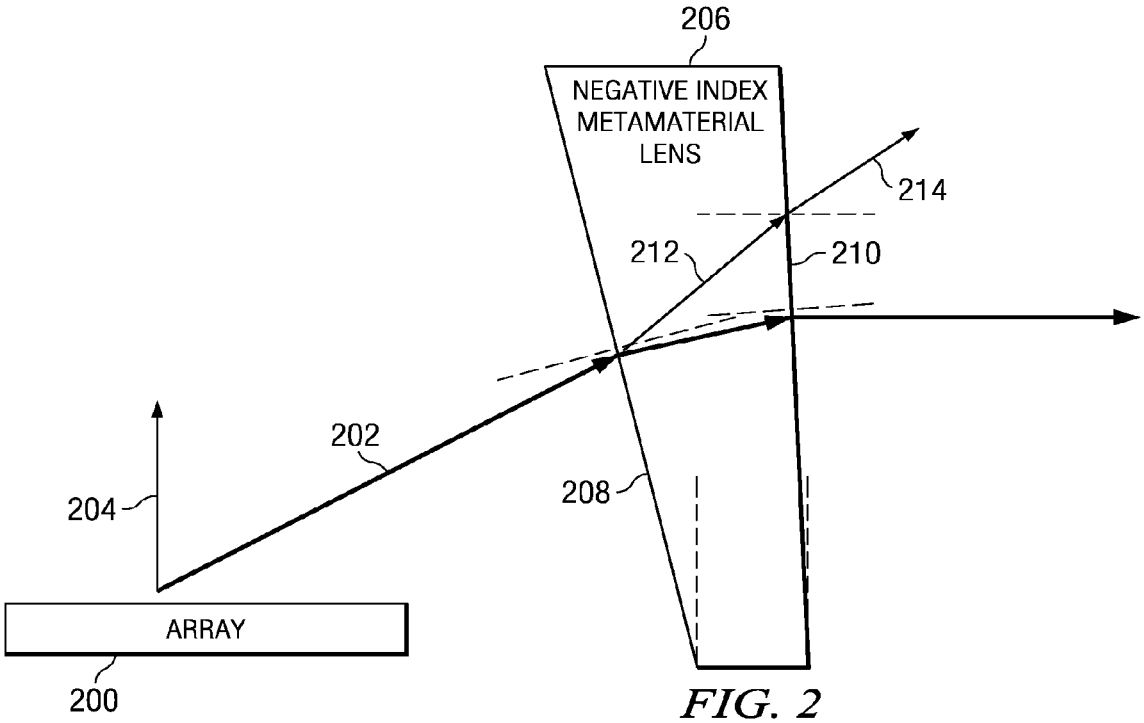
FIG. 2 is a diagram illustrating the operation of a phased array antenna using a negative index metamaterial lens in accordance with an advantageous embodiment.

Turning now to FIG. 2, a diagram illustrating the operation of a phased array antenna using a negative index metamaterial lens is depicted in accordance with an advantageous embodiment. In this example, array 200 is an example of an array, such as array 108 in FIG. 1. Array 200 may be, for example, a 64 element array. In this type of implementation, an 8×8 array may be arranged in a triangular lattice. Of course, the different advantageous embodiments may be applied to other types and sizes of arrays.

In this illustrative example, array 200 outputs beam 202. Beam 202 is a radio frequency emission generated by the different elements in array 200. The transmission of signals by array 200 occurs in a manner that beam 202 is steered in a direction that is around 60 degrees from normal 204. Beam 202 enters negative index metamaterial lens 206 at surface 208. Negative index metamaterial lens 206 is shown in cross-section and is an example of negative index metamaterial lens 110 in FIG. 1.

As beam 202 travels through negative index metamaterial lens 206, beam 202 is bent or directed in a manner that beam 202 is emitted or exits negative index metamaterial lens 206 at surface 210 in a direction that is around horizontal. Of course, the final direction of beam 202 may vary depending on the steering of beam 202 prior to entering negative index metamaterial lens 206. The path indicated by arrows 212 and 214 show a beam path with normal material used for a lens. As can be seen, in this path a direction that is around horizontal does not occur.

Figure 3:
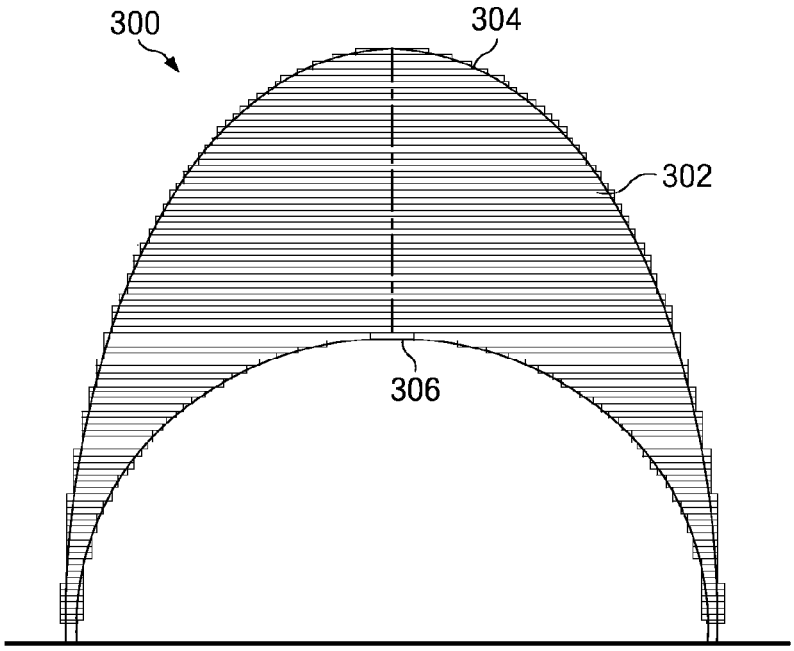
FIG. 3 is an example of a negative index metamaterial lens design in accordance with an advantageous embodiment.

A negative index metamaterial lens may have a number of different forms. In the advantageous embodiments, a negative index metamaterial lens is designed based on two curves, such as parabolas. Turning now to FIG. 3, an example of a negative index metamaterial lens is depicted in accordance with an advantageous embodiment. In this example, lens 300 is an example of an index metamaterial lens that may be used with a phased array antenna.

In this example, lens 300 includes negative index metamaterial unit cells 302 between ellipse 304 and ellipse 306. Negative index metamaterial unit cells 302 form the material for lens 300. In these illustrative examples, negative index metamaterial unit cells 302 are placed between ellipse 304 and ellipse 306 in layers. In these illustrative examples, ellipse 304 and ellipse 306 are only outlines of boundaries for lens 300. These ellipses are not actually part of lens 300.

The layers containing negative index metamaterial unit cells 302 are aligned with other layers of these unit cells to maintain a crystalline stacking. Crystalline stacking occurs when the unit cell boundaries of one layer are aligned with unit cell boundaries in another layer. Non-crystalline stacking occurs if the boundaries between unit cells different layers are not aligned. The height of each layer is one unit cell thick while the width of each layer may be a number of unit cells or a single unit cell designed to the appropriate size.

Figure 4:
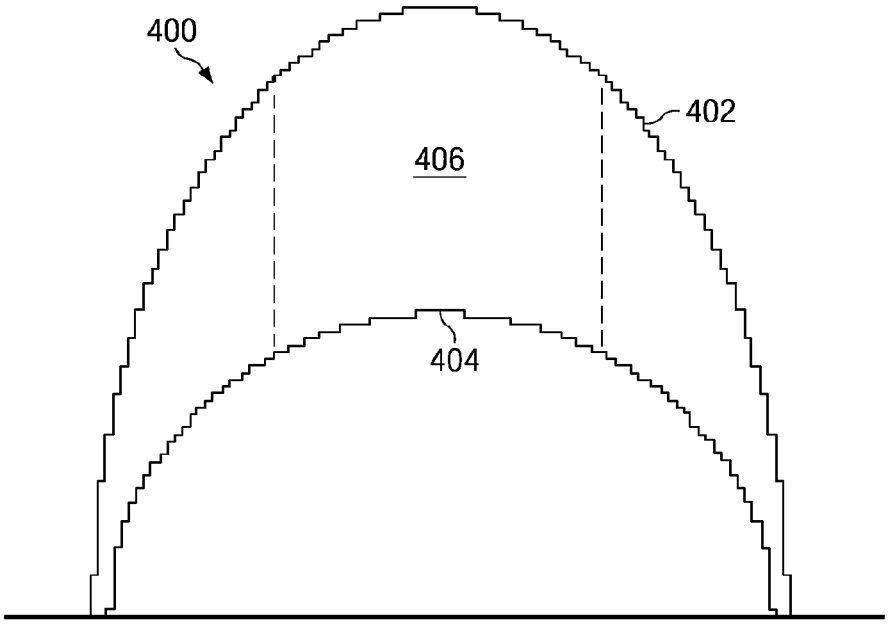
FIG. 4 is a diagram illustrating an outline of a negative index metamaterial lens in accordance with an advantageous embodiment.

Turning now to FIG. 4, a diagram illustrating an outline of a negative index metamaterial lens is depicted in accordance with an advantageous embodiment. Lens outline 400 is an outline of a negative index metamaterial lens, such as lens 300 in FIG. 3.

In this example, lens outline 400 results from the placement of negative index metamaterial cells between ellipses 304 and 306 in FIG. 3. Lens outline 400 has outer edge 402 and inner edge 404. Lens outline 400 has a discrete or jagged look. In actual implementation, this design may be rotated 360 degrees to form a three-dimensional design for a negative index metamaterial lens.

Additionally, lens outline 400 may have a portion removed, such as a portion within section 406, to reduce weight and interference for directions in which additional bending of a beam is unnecessary.

Figure 5:
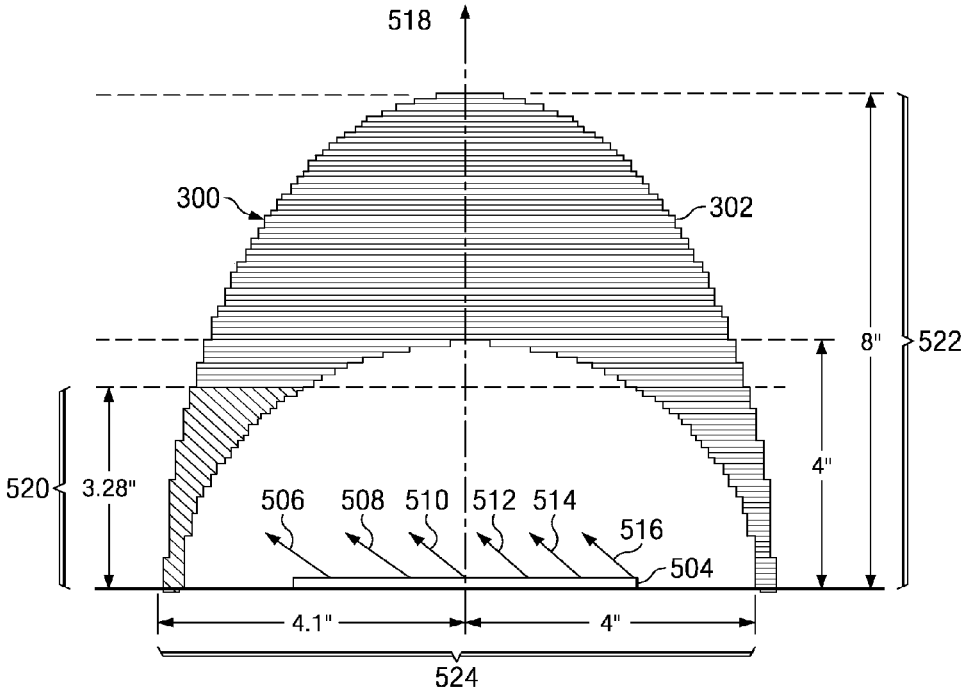
FIG. 5 is a diagram illustrating a cross-section of a lens in relation to an array for a phased array antenna in accordance with an advantageous embodiment.

With reference now to FIG. 5, a diagram illustrating a cross-section of a lens in relation to an array for a phased array antenna is depicted in accordance with an advantageous embodiment. In this example, lens 300 is shown with respect to array 504. Array 504 is an array of radio frequency emitters. In particular, array 504 may emit radio frequency signals in the form of microwave transmissions.

Array 504 may emit radio frequency emissions 506, 508, 510, 512, 514, and 516 to form a beam that may be transmitted at an angle of around 60 degrees with respect to normal vector 518.

Lens 300 is designed, in this example, with the inner ellipse having a circle of around 4 inches, an outer ellipse having a semi-major axis of 8 inches, and a semi-minor axis of 4.1 inches. In this example, lens 300 may be designed to only include a portion of lens 300 within section 520. In this example, lens 300 may have a height of around 8 inches as shown in section 522. Lens 300 may have a width of around 8.1 inches as shown in section 524.

Of course, the illustration of lens 300 in FIG. 5 is shown as a two-dimensional cross-section of a negative index metamaterial lens.

Figure 6:
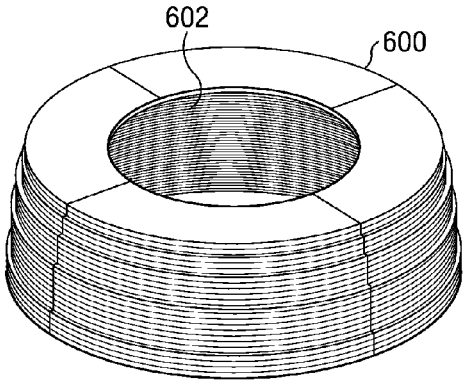
FIG. 6 is a diagram of a lens in accordance with an advantageous embodiment.

Turning now to FIG. 6, a diagram of a lens is depicted in accordance with an advantageous embodiment. In this illustrative example, lens 600 is presented in a perspective view. Lens 600 is the portion of lens 300 in section 520 in FIG. 5. In this example, the array of antenna elements is located within channel 602 of lens 600. In this example, the array is not visible.

Figure 7:
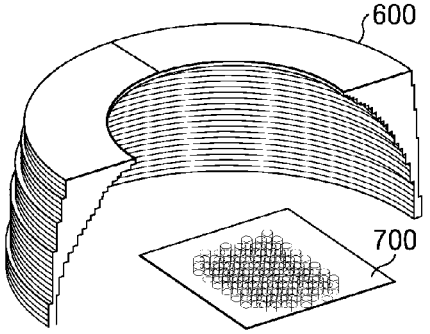
FIG. 7 is a cross-sectional view of a lens in accordance with an advantageous embodiment.

With reference now to FIG. 7, a cross-sectional perspective view of lens 600 is depicted in accordance with an advantageous embodiment. In this example, array 700 is an example of an array of antenna elements for a phased array antenna that may be present. This cross-sectional perspective view is presented to show a perspective view of array 700 with a portion of lens 600.

Figure 8:
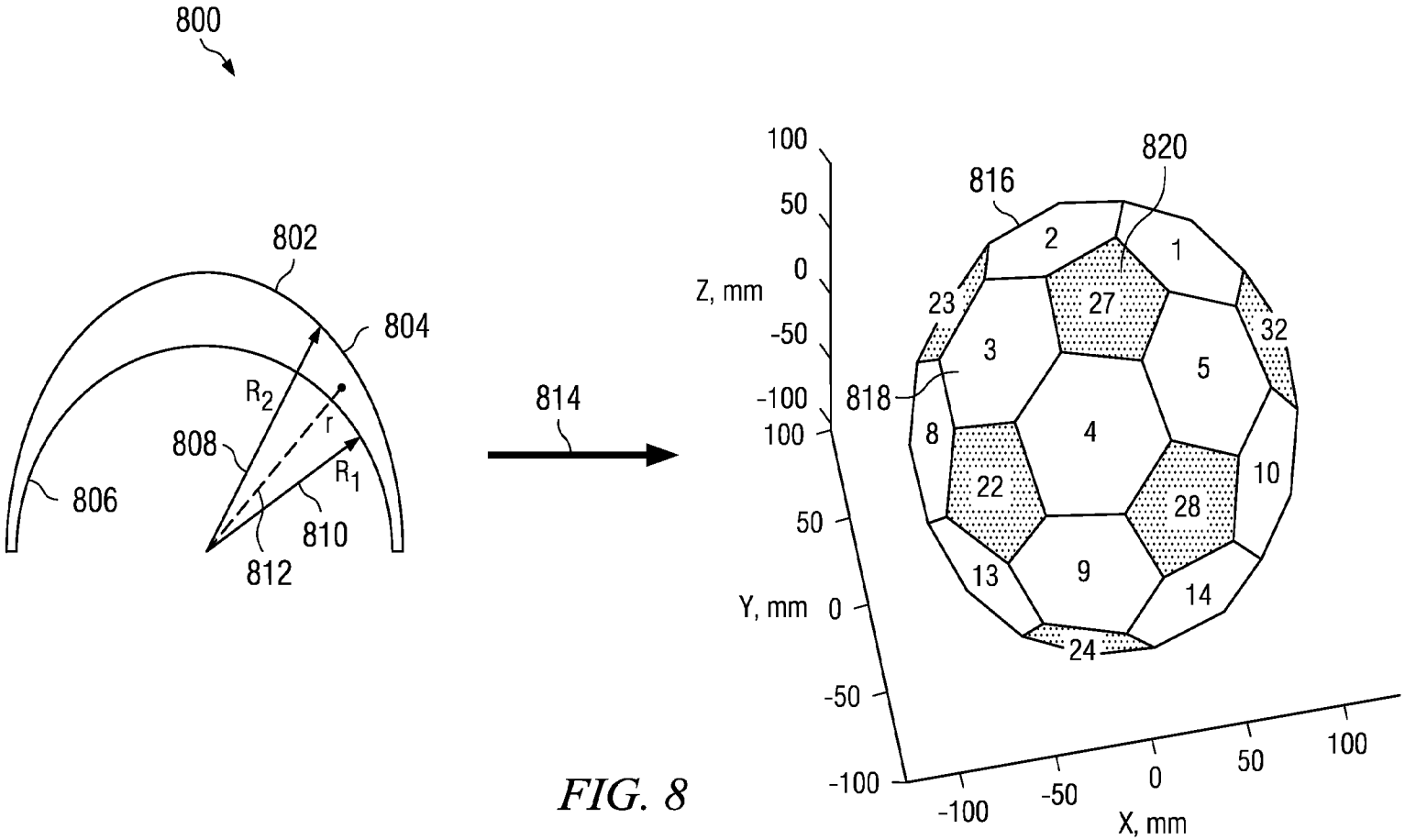
FIG. 8 is a diagram illustrating a lens design in accordance with an advantageous embodiment.

With reference now to FIG. 8, a diagram illustrating a lens design is depicted in accordance with an advantageous embodiment. In this example, lens shape 800 is a truncated icosahedron. Lens shape 800 also may be referred to as a buckyball shape. Although lens shape 800 is shown as an entire or complete buckyball, the buckyball shape for lens 800 may be a portion of a buckyball. In other words, the buckyball shape for lens shape 800 may not be an entire "ball".

In the different advantageous embodiments, lens design 802 is an example of the lens design for lens 300 in FIG. 3. As illustrated, lens design 802 contains ellipse 804 and ellipse 806. Ellipse 804 has radius 808, while ellipse 806 has radius 810. Ellipse 804 may be referred to as an outer ellipse, while ellipse 806 may be referred to as an inner ellipse. Radius 808 may be an outer radius, while radius 810 may be an inner radius for lens design 802. Radius 812 is around an average of radius 808 and radius 810.

Lens design 802 may be turned into lens shape 800 in these illustrative examples. In this illustrative example, shell 816 of lens shape 800 may be selected to have an average radius roughly equal to radius 812 of lens design 802.

Shell 816 of lens shape 800 has two types of faces in these examples. These faces include, for example, hexagonal face 818 and pentagonal face 820. In this depicted example, each face on shell 816 may be given an initial thickness for discrete components, such as elements formed from unit cell assemblies in a radial direction. This initial thickness may be, for example, six unit cell assemblies thick. Of course, other thicknesses may be selected in other embodiments.

The thickness of each face may be selected by taking into consideration unit cell index of refraction range availability and losses. With a thicker face, the particular face has more capability to bend radio frequency signals in the form of a beam. Further, less extreme values of an index of refraction also may be used with a thicker face. A face is a loss medium with respect to the transmission of a beam through a face. Thus, a thicker face may result in increased losses as compared to a thinner face. In other words, more losses may occur in the beam, because the beam travels a longer distance through the thicker face as compared to a thinner face.

For each face on shell 816, conformal transformation 814 is performed to transform lens design 802 into lens shape 800. Conformal transformation 814 may be performed using commonly available conformal transformation processes and/or algorithms. Conformal transformation 814 is an angle preserving transformation and may also be referred to as conformal mapping. Conformal transformation 814 is used to transform or map one geometry to another geometry. In these illustrative examples, conformal transformation 814 may be performed for points on each face on shell 816.

After the conformal transformation is performed, a new index of refraction is identified for lens shape 800. If the new index of refraction is within the unit cell design range and losses are acceptable, the design of lens shape 800 is complete. If the index of refraction for the points on any of the faces in shell 816 is outside of the unit cell design range, then the unit cell type may be changed, or a different thickness may be chosen for that face.

Alternatively, the thickness for each face also may be changed. The thickness of each face also may be changed depending on the losses. In the illustrated examples, losses come from resistive and/or dielectric losses inside the unit cell. In these illustrative examples, a loss may be considered acceptable if the total loss through the thickness of a face is less than around 3 dB. Of course, depending on the particular implementation, higher loss levels may be selected as a threshold for an acceptable amount of loss. Also, in some advantageous embodiments, the transmit power of the array may be increased to compensate for the losses and signal attenuation that may occur.

With lens shape 800, a full dome coverage may be provided for a phased array in a manner that may avoid edge discontinuity that may occur with lens 300 in FIG. 3.

Figure 9:
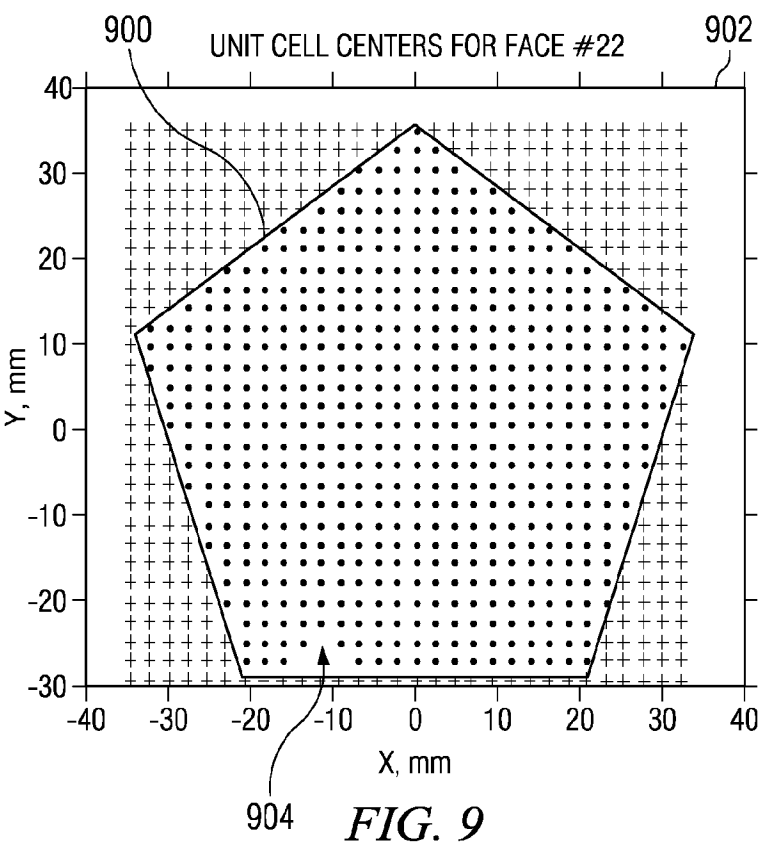
FIG. 9 is a diagram illustrating a face of a buckyball shell in accordance with an advantageous embodiment.

With reference now to FIG. 9, a diagram illustrating a face of a buckyball shell is depicted in accordance with an advantageous embodiment. Face 900 is an example of pentagonal face 820 on shell 816 in FIG. 8. Face 900 is shown within graph 902 in which the x-axis is in millimeters, and the y-axis is in millimeters. Points 904 within face 900 are points in which conformal transformation may be performed from lens design 802 using conformal transformation 814 to obtain lens shape 800 in FIG. 8. The conformal transformation is performed through each point within points 904 in face 900. Each point in points 904 may have a slightly different refractive index value.

Figure 10:
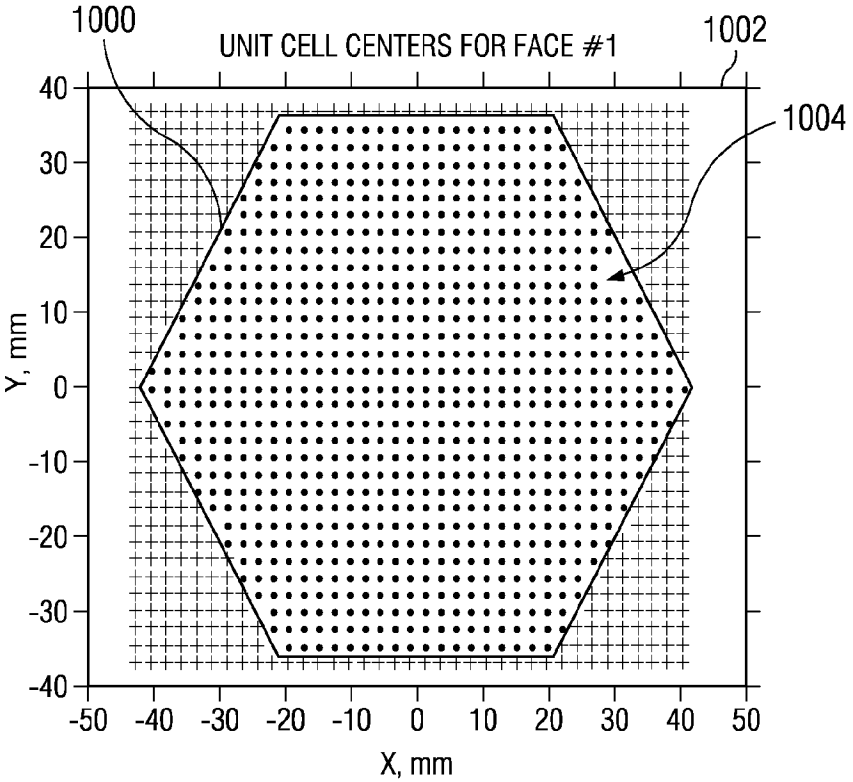
FIG. 10 is a diagram of a face in a buckyball lens shape in accordance with an advantageous embodiment.

With reference now to FIG. 10, a diagram of a face in a buckyball shell is depicted in accordance with an advantageous embodiment. In this example, face 1000 is an example of hexagonal face 818 on shell 816 in FIG. 8. Face 1000 is shown within graph 1002 in which the x-axis is in millimeters, and the y-axis is in millimeters. A conformal transformation is performed for each point within points 1004 to map lens design 802 to shell 816 in FIG. 8.

Points 1004 within face 1000 are points on which conformal transformations are performed in this example. The number of points may be determined by the size of the unit cell assemblies. The distance between the points is the length of the unit cell assembly, which may be around 2.31 millimeters in this illustrative example. A uniform grid with a spacing of around 2.31 mm by around 2.31 mm is overlaid on top of a face. Points inside the face are included in the transformation. These points represent the center location of the unit cell assemblies.

Figure 11:
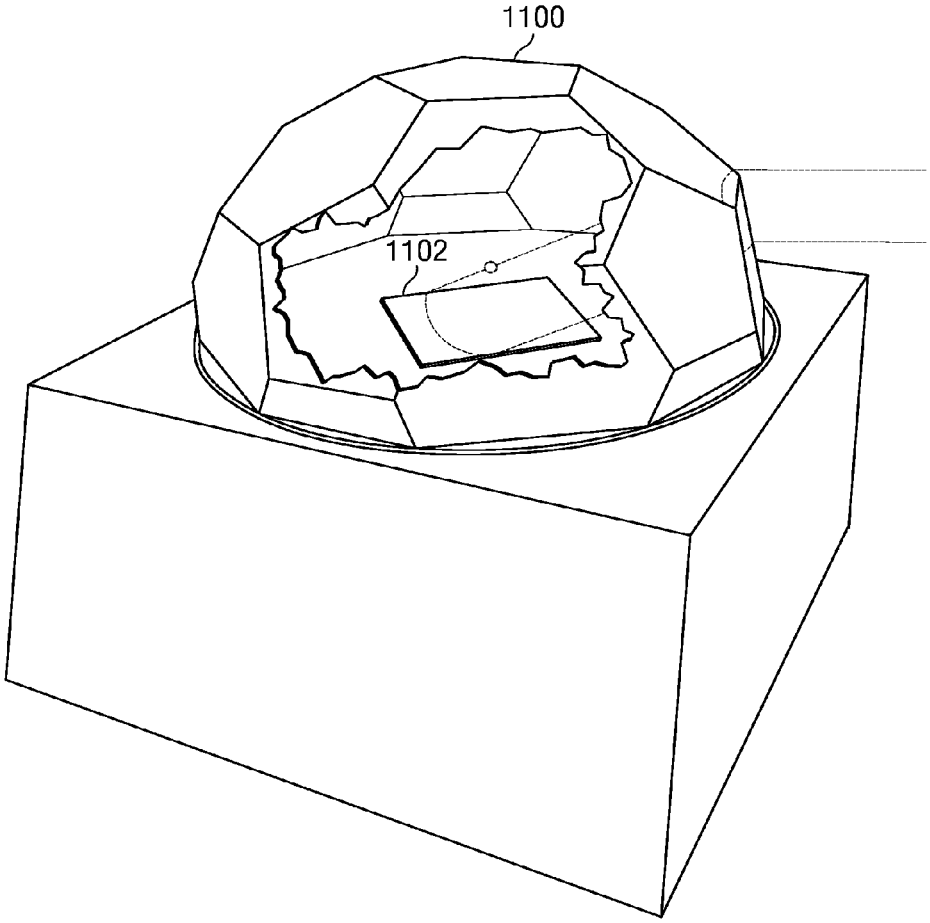
FIG. 11 is a diagram of a lens using a buckyball shape in accordance with an advantageous embodiment.

With reference now to FIG. 11, a diagram of a lens having a buckyball shape is depicted in accordance with an advantageous embodiment. In this example, lens 1100 is presented in a perspective view. Lens 1100 has a buckyball or truncated icosahedron shape. This buckyball shape is not an entire buckyball but a portion of a buckyball that may be selected to cover array 1102. This portion of the buckyball also may be referred to as a dome. Lens 1100 is shown in an exposed view to depict array 1102 inside of lens 1100.

Figure 12:
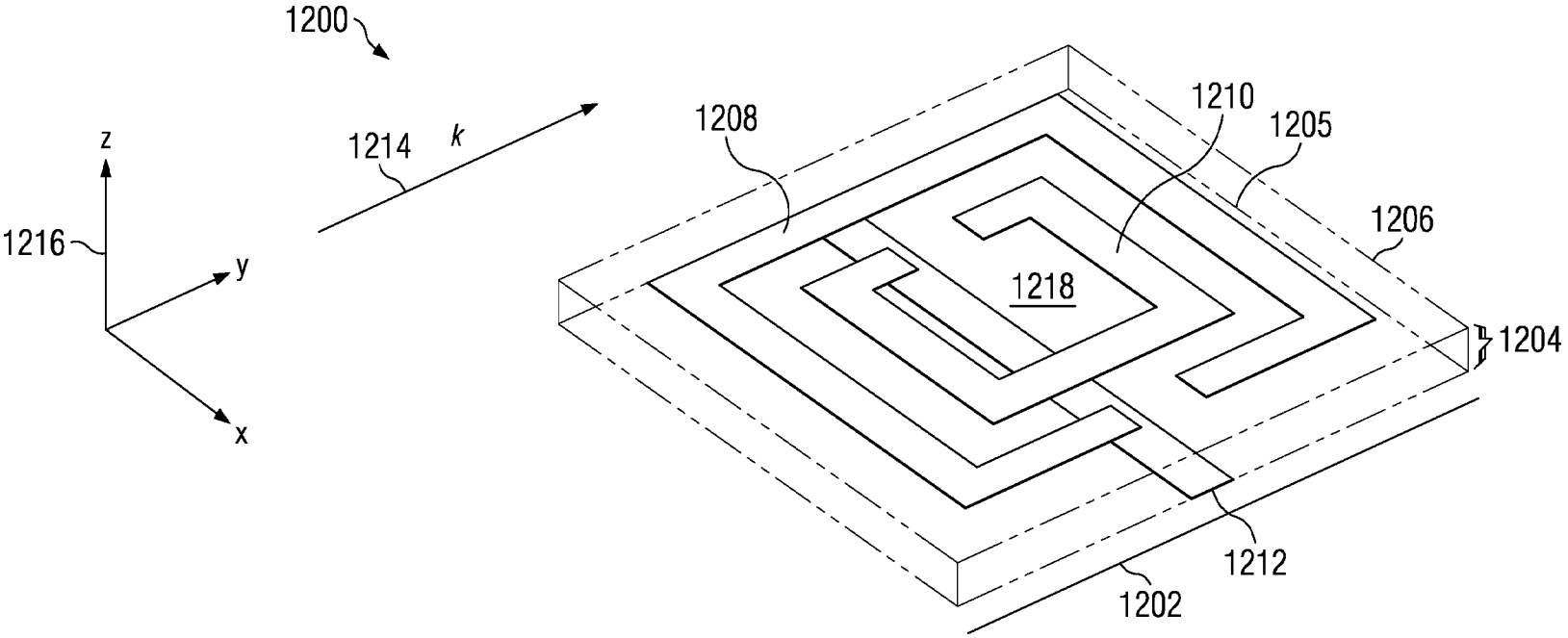
FIG. 12 is a diagram of a cell in accordance with an advantageous embodiment.

With reference now to FIG. 12, a diagram of a cell is depicted in accordance with an advantageous embodiment. In this example, cell 1200 is an example of a negative index metamaterial unit cell that may be used to form a lens, such as lens 400 in FIG. 4. As depicted, cell 1200 is square shaped. Cell 1200 has length 1202 along each of the sides and height 1204. In these examples, length 1202 may be, for example, around 2.3 millimeters. Height 1204 may be the height of the substrate. For example, the height may be around 10 millimeters. These dimensions may vary depending on the particular implementation. Cell 1200 comprises substrate 1206.

Substrate 1206 provides support for copper rings and wire traces, such as split ring resonator 1205, which includes traces 1208 and 1210. Additionally, substrate 1206 also may contain trace 1212. In these examples, substrate 1206 may have a low dielectric loss tangent to reduce the over loss of the unit cell. In these examples, substrate 1206 may be, for example, alumina. Another example of a substrate that may be used is an RT/Duroid® 5870 high frequency laminate. This type of substrate may be available from Rogers Corporation. Of course, any type of material may be used for substrate 1206 to provide a mechanical carrier of structure for the arrangement and design of the different traces to achieve the desired E and H fields.

Split ring resonator 1205 is used to provide some of the properties to generate a negative index of refraction for cell 1200. Traces 1208 and 1210 provide negative permeability for a magnetic response. Split ring resonator 1205 creates a negative permeability caused by the reaction of the pattern of these traces to energy. Trace 1212 also provides for negative permittivity.

In this example, wave propagation vector k 1214 is in the y direction as indicated by reference axis 1216. Split ring resonator 1205 couples the Hz component to provide negative permeability in the z direction. Trace 1212 is a wire that couples the Ex component providing negative permittivity in the x direction by stacking cell 1200 with cells in other planes coupling of other E and H field components may be achieved.

Although a particular pattern is shown for split ring resonator 1205, other types of pattern may be used. For example, the patterns may be circular rather than square in shape for split ring resonator 1205. Various parameters may be changed in split ring resonator 1205 to change the permeability of the structure. For example, the orientation of split ring resonator 1205, with respect to trace 1212, can change the magnetic permeability of cell 1200.

As another example, the width of the loop formed by trace 1208, the width of the inner loop formed by trace 1210, the use of additional paramagnetic materials within area 1218, and a type of pattern as well as other changes in the features of cell 1200 may change the permeability of cell 1200. The permittivity of cell 1200 also may be changed by altering various components, such as the material for trace 1212, the width of trace 1212, and the distance of trace 1212 from split ring resonator 1205.

Figure 13:
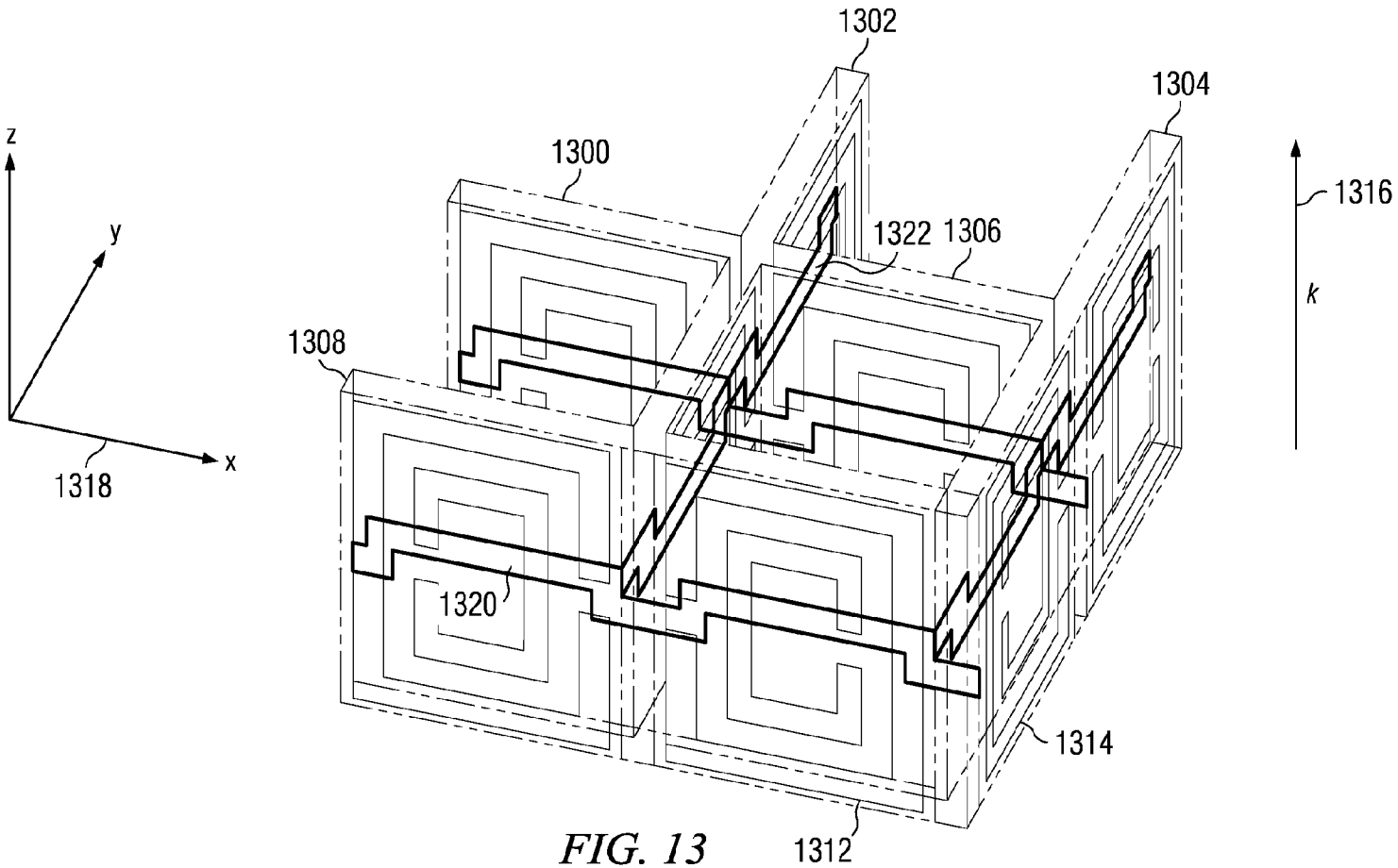
FIG. 13 is a unit cell arrangement in accordance with an advantageous embodiment.

With reference now to FIG. 13, a unit cell arrangement is depicted in accordance with an advantageous embodiment. In this example, unit cells 1300, 1302, 1304, 1306, 1308, 1312, and 1314 are depicted. These unit cells are similar to cell 1200 in FIG. 12.

In this example, wave vector k 1316 is in the z direction with reference to axis 1318. Permittivity and permeability are negative both in the x and y directions with this type of architecture. A notch, such as notch 1320 and notch 1322, is present in the y wires so that they do not cross each other in these examples. To avoid wire intersections, routing notches are included at the cell boundary. The notches and the stacking of cells are shown in more detail with respect to FIGS. 14 and 15 below.

With reference now to FIG. 14, a diagram illustrating two unit cells is depicted in accordance with an advantageous embodiment. In this example, element 1400 includes unit cell 1402 and unit cell 1404 performed in substrate 1406.

Wire trace 1408 runs through both unit cells 1402 and 1404. Unit cell 1402 has split ring resonator 1409 formed by traces 1410 and 1412. Unit cell 1404 has split ring resonator 1413 formed by traces 1414 and 1416. As can be seen in this illustration, element 1400 has notch 1418 between unit cells 1402 and 1404 to allow for perpendicular stacking and/or assembly.

With reference now FIG. 15, an illustration of unit cells positioned for assembly is depicted in accordance with an advantageous embodiment. In this example, element 1500 includes unit cells 1502 and 1504. Element 1506 contains unit cells 1508 and 1510. As can be seen, notches 1512 and 1514 are present in elements 1500 and 1506. Elements 1500 and 1506 are positioned to allow engagement for assembly for these two elements at notches 1512 and 1514. These elements are also referred to as unit cell assemblies.

Figure 16:
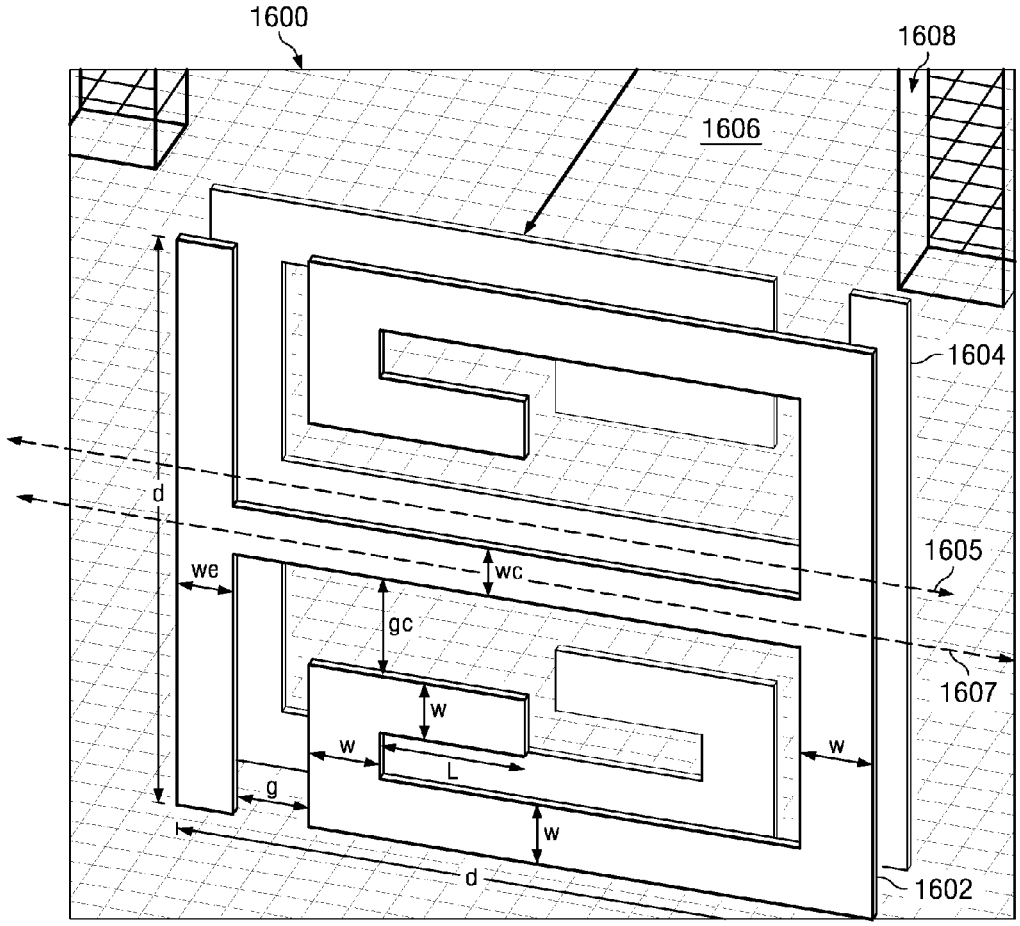
FIG. 16 is a diagram of a unit cell in accordance with an advantageous embodiment.

With reference now to FIG. 16, a diagram of a unit cell is depicted in accordance with an advantageous embodiment. In this example, unit cell 1600 has trace 1602 and trace 1604. Traces 1602 and 1604 may be symmetric about center lines 1605 and 1607 of traces 1602 and 1604, respectively. In other words, trace 1602 may be located substantially between surfaces 1606 and 1608. Trace 1604 may be located on surface 1606. Trace 1604 may have an identical pattern to trace 1602 but may be rotated 180 degrees around an axis normal to surfaces 1606 and 1608.

Turning to FIG. 17, a table illustrating dimensions for a cell is depicted in accordance with an advantageous embodiment. Table 1700 illustrates dimensions for trace 1602 and trace 1604 in unit cell 1600 in FIG. 16. These dimensions are in millimeters.

Figure 18:
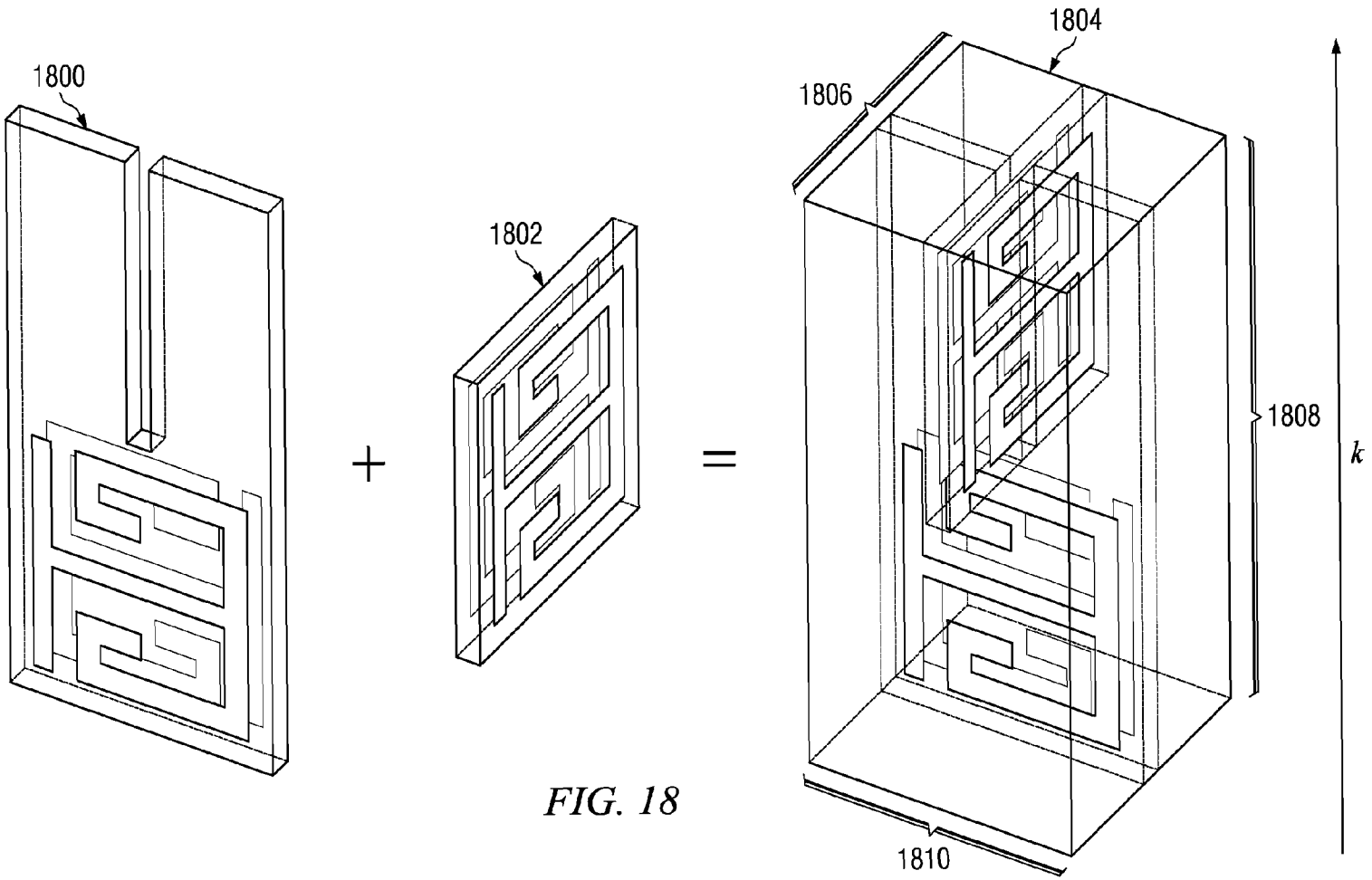
FIG. 18 is a diagram illustrating unit cell assembly in accordance with an advantageous embodiment.

With reference now to FIG. 18, a diagram illustrating unit cell assembly is depicted in accordance with an advantageous embodiment. In this example, unit cell 1800 contains traces similar to those for cell 1600. Cell 1802 also contains trace patterns similar to cell 1600 in FIG. 16. Cell 1800 and cell 1802 may be assembled to form element 1804, which is a unit cell assembly.

Element 1804 may be a discrete component for a lens. In this example, element 1804 has width 1806, thickness 1808, and length 1810. Thickness 1808 is a thickness of this element. Thickness 1808 is in the direction of the wave propagation, wave propagation vector k.

The illustration of the different unit cell designs and assemblies are not meant to imply architectural or physical limitations to the manner in which different unit cells may be assembled to form discrete components for different cell designs. Other designs for cells and other types of assemblies may be employed, depending on the particular implementation.

Figure 19:
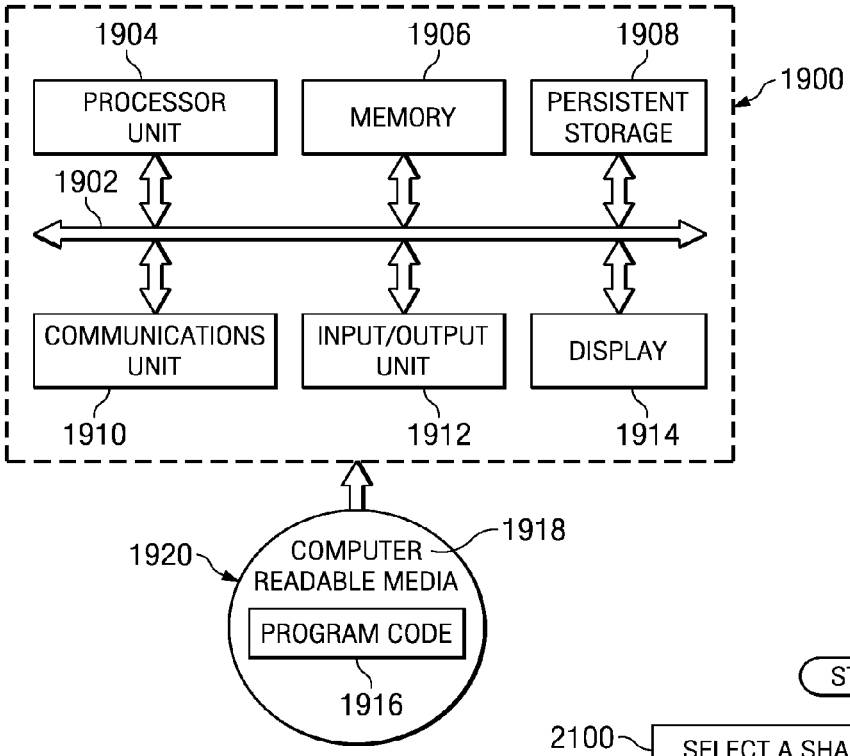
FIG. 19 is a diagram of a data processing system in accordance with an advantageous embodiment.

Turning now to FIG. 19, a diagram of a data processing system is depicted in accordance with an advantageous embodiment. Data processing system 1900 in FIG. 19 is an example of a data processing system that may be used to create designs for negative index metamaterial lenses as well as perform simulations of those lenses within a phased array antenna. Data processing system 1900 also may be used to design and perform simulations on unit cells for the lenses.

In this illustrative example, data processing system 1900 includes communications fabric 1902, which provides communications between processor unit 1904, memory 1906, persistent storage 1908, communications unit 1910, input/output (I/O) unit 1912, and display 1914.

Processor unit 1904 serves to execute instructions for software that may be loaded into memory 1906. Processor unit 1904 may be a set of one or more processors or may be a multi-processor core, depending on the particular implementation. Further, processor unit 1904 may be implemented using one or more heterogeneous processor systems in which a main processor is present with secondary processors on a single chip. As another illustrative example, processor unit 1904 may be a symmetric multi-processor system containing multiple processors of the same type.

Memory 1906 and persistent storage 1908 are examples of storage devices. A storage device is any piece of hardware that is capable of storing information either on a temporary basis and/or a permanent basis. Memory 1906, in these examples, may be, for example, a random access memory or any other suitable volatile or non-volatile storage device. Persistent storage 1908 may take various forms depending on the particular implementation.

For example, persistent storage 1908 may contain one or more components or devices. For example, persistent storage 1908 may be a hard drive, a flash memory, a rewritable optical disk, a rewritable magnetic tape, or some combination of the above. The media used by persistent storage 1908 also may be removable. For example, a removable hard drive may be used for persistent storage 1908.

Communications unit 1910, in these examples, provides for communications with other data processing systems or devices. In these examples, communications unit 1910 is a network interface card. Communications unit 1910 may provide communications through the use of either or both physical and wireless communications links.

Input/output unit 1912 allows for input and output of data with other devices that may be connected to data processing system 1900. For example, input/output unit 1912 may provide a connection for user input through a keyboard and mouse. Further, input/output unit 1912 may send output to a printer. Display 1914 provides a mechanism to display information to a user.

Instructions for the operating system and applications or programs are located on persistent storage 1908. These instructions may be loaded into memory 1906 for execution by processor unit 1904. The processes of the different embodiments may be performed by processor unit 1904 using computer implemented instructions, which may be located in a memory, such as memory 1906. These instructions are referred to as program code, computer usable program code, or computer readable program code that may be read and executed by a processor in processor unit 1904. The program code in the different embodiments may be embodied on different physical or tangible computer readable media, such as memory 1906 or persistent storage 1908.

Program code 1916 is located in a functional form on computer readable media 1918 that is selectively removable and may be loaded onto or transferred to data processing system 1900 for execution by processor unit 1904. Program code 1916 and computer readable media 1918 form computer program product 1920 in these examples. In one example, computer readable media 1918 may be in a tangible form, such as, for example, an optical or magnetic disc that is inserted or placed into a drive or other device that is part of persistent storage 1908 for transfer onto a storage device, such as a hard drive that is part of persistent storage 1908.

In a tangible form, computer readable media 1918 also may take the form of a persistent storage, such as a hard drive, a thumb drive, or a flash memory that is connected to data processing system 1900. The tangible form of computer readable media 1918 is also referred to as computer recordable storage media. In some instances, computer readable media 1918 may not be removable.

Alternatively, program code 1916 may be transferred to data processing system 1900 from computer readable media 1918 through a communications link to communications unit 1910 and/or through a connection to input/output unit 1912. The communications link and/or the connection may be physical or wireless in the illustrative examples. The computer readable media also may take the form of non-tangible media, such as communications links or wireless transmissions containing the program code.

The different components illustrated for data processing system 1900 are not meant to provide architectural limitations to the manner in which different embodiments may be implemented. The different illustrative embodiments may be implemented in a data processing system including components in addition to or in place of those illustrated for data processing system 1900. Other components shown in FIG. 19 can be varied from the illustrative examples shown.

As one example, a storage device in data processing system 1900 is any hardware apparatus that may store data. Memory 1906, persistent storage 1908 and computer readable media 1918 are examples of storage devices in a tangible form.

In another example, a bus system may be used to implement communications fabric 1902 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 1906 or a cache such as found in an interface and memory controller hub that may be present in communications fabric 1902.

Figure 20:
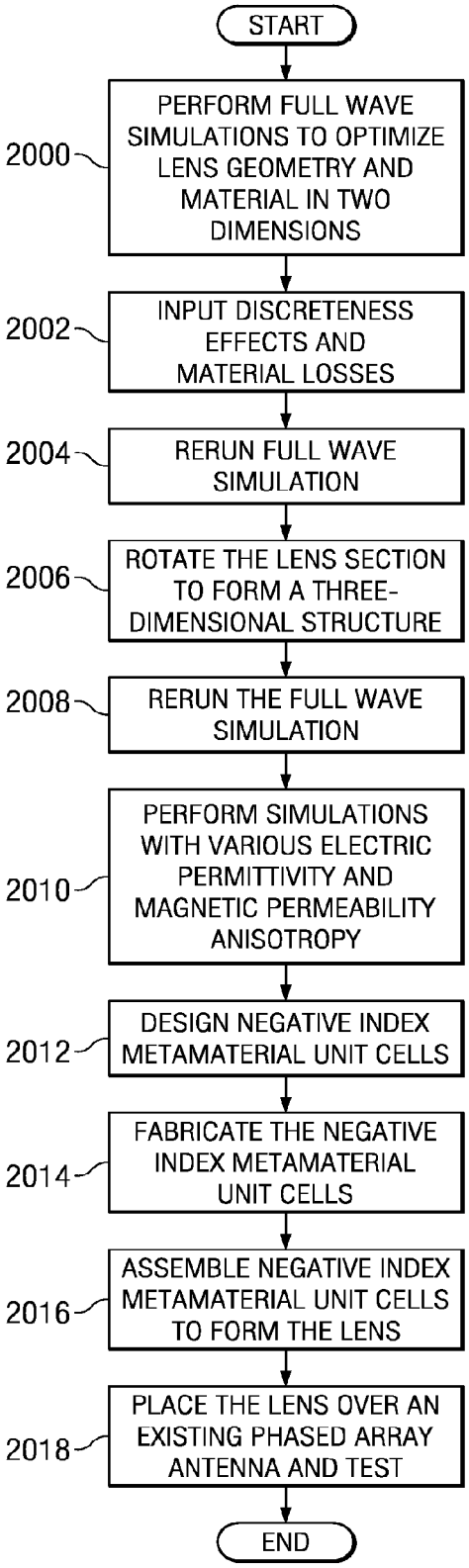
FIG. 20 is a flowchart of a process for manufacturing a negative index metamaterial lens for a phased array antenna in accordance with an advantageous embodiment.

Turning now to FIG. 20, a flowchart of a process for manufacturing a negative index metamaterial lens for a phased array antenna is depicted in accordance with an advantageous embodiment. In this example, the process may be used to create a lens, such as lens 600 in FIG. 6. The different steps involving design, simulations, and optimizations may be performed using a data processing system, such as data processing system 1900 in FIG. 19.

The process begins by performing full wave simulations to optimize lens geometry and material in two dimensions (operation 2000). In operation 2000, the full wave simulation is a known type of simulation involving Maxwell's equations for electromagnetism. This type of simulation involves solving full wave equations with all the wave effects taken into account. In operation 2000, the lens geometry and the material to bend the beam from around 60 degrees steering to around 90 degrees steering is optimized using the simulations. This 90 degrees steering is from horizontal for near horizontal scanning in a phased array antenna.

Thereafter, the process inputs discreteness effects and material losses (operation 2002). The discreteness takes into account that negative index metamaterial unit cells are used to form the lens. With this type of material, a smooth surface may not be possible. The process then reruns the full wave simulation with the discreteness effects and material losses (operation 2004). This operation confirms that the performance identified in operation 2000 is still at some acceptable level with losses and fabrication limitations.

Thereafter, the lens section is rotated to form a three-dimensional structure (operation 2006). The process then reruns the full wave simulation using the three-dimensional structure (operation 2008). Operation 2008 is used to confirm whether the lens geometry and materials optimized in a two-dimensional model are still valid in a three-dimensional model.

The process then performs simulations with various electric permittivity and magnetic permeability anisotropy (operation 2010). The simulations in operation 2010 are also full wave simulations. The difference in this simulation is that full isotropic materials are used with respect to previous simulations. The simulation in operation 2010 may be run using different levels of anistroptry to determine if reduced materials may be used. This operation may be performed to find reduced materials to make fabrication easier with acceptable or reasonable performance.

A reduced material is an anistroptric material that only couples to E and H fields in one or two selected directions, rather than all three directions like an isotropic material. A reduced material may be desirable because of easier fabrication. For example, rather than stacking unit cells in all three directions, fabrication of cells is easier if only two directions or one direction is used. Next, the negative index metamaterial unit cells are designed (operation 2012). In this example, parameters are identified for a negative index metamaterial unit cell to allow for the operation of the desired frequencies and correct anisotropy.

The process fabricates the negative index metamaterial unit cells (operation 2014). In operation 2014, the fabrication of the unit cells may be performed using various currently available fabrication processes. These processes may include those used for fabricating semiconductor devices. The process assembles the negative index metamaterial unit cells to form the lens (operation 2016). In this operation, the final lens with the appropriate geometry orientation, material anisotropy, and mechanical integrity is formed. The fabricated lens is then placed over an existing phased array antenna and tested (operation 2018), with the process terminating thereafter. Operation 2018 confirms whether the lens bends the beam as predicted by the simulations.

Figure 21:
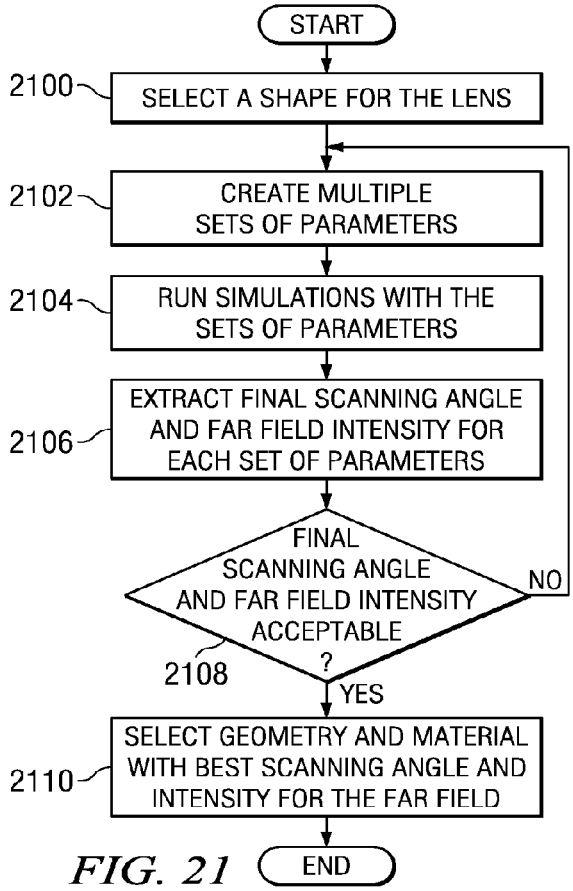
FIG. 21 is a flowchart of a process for optimizing a lens design in accordance with an advantageous embodiment.

With reference now to FIG. 21, a flowchart of a process for optimizing a lens design is depicted in accordance with an advantageous embodiment. The process illustrated in FIG. 21 is a more detailed explanation of operation 2000 in FIG. 20.

The process begins by selecting a shape for the lens (operation 2100). In these examples, the shape is a pair of ellipses that encompass an area to define a lens. Of course, in other embodiments, other shapes may be selected. Even arbitrary shapes may be selected, depending on the particular implementation. The pair of ellipses includes an inner ellipse with a semi-minor axis, a semi-major axis, and an outer ellipse with a similar axis.

The process creates multiple sets of parameters for the selected shape (operation 2102). In these different sets, various parameters for the shape and material of the lens may be varied. In these examples, the parameters for the semi-major and semi-minor axis may be varied. With this particular example, some constraints may include selecting the semi-minor axis and the semi-major axis of the inner ellipse as being larger than the nominal dimension of the antenna array. Further, the semi-minor axis of the inner ellipse is less than the semi-minor axis of the outer ellipse. Additionally, the semi-major axis of the inner ellipse is always less than the semi-major axis of the outer ellipse.

In the different advantageous embodiments, the semi-minor axis of the inner ellipse may be fixed for the different sets of parameters, while the size and eccentricities of the inner and outer ellipse are varied by changing the other parameters in a range centered about the initial values. Further, the negative index of refraction also may be varied.

The process then runs a full wave simulation with the different sets of parameters (operation 2104). The simulations may be run in two dimensions or three dimensions. With large design spaces, a two-dimensional simulation may be performed for faster results. Based on the two-dimensional results, the optimized lens may be rotated in three dimensions, with the simulations then being rerun in three dimensions to verify the results.

The process then extracts the final scanning angle and far field intensity for each set of parameters (operation 2106). Thereafter, a determination is made as to whether the final scanning angle and far field intensity are acceptable (operation 2108).

If the final scanning angle and far field intensity are acceptable, the process selects a geometry and material with the best scanning angle and intensity for the far field (operation 2110), with the process terminating thereafter. In these examples, this simulation may be run without any discreteness in the ellipses. With reference again to operation 2108, if the final scanning angle and far field intensity are not both acceptable, the process returns to operation 2102. The process then creates additional sets of parameters for testing.

The different simulations performed in operation 2104 include full wave electromagnetic simulations. These simulations may be performed using various available programs. For example, COMSOL Multiphysics version 3.4 is an example simulation program that may be used. This program is available from COMSOL AB. This type of simulation simulates the radio frequency transmissions from wave guide elements with a beam pointed in the direction that is desired. Further, the simulation program also simulates the lens with the geometry, materials, and an air box with wave propagation. From these simulations, information about relative far field intensity and final angle of the beam may be identified.

Figure 22:
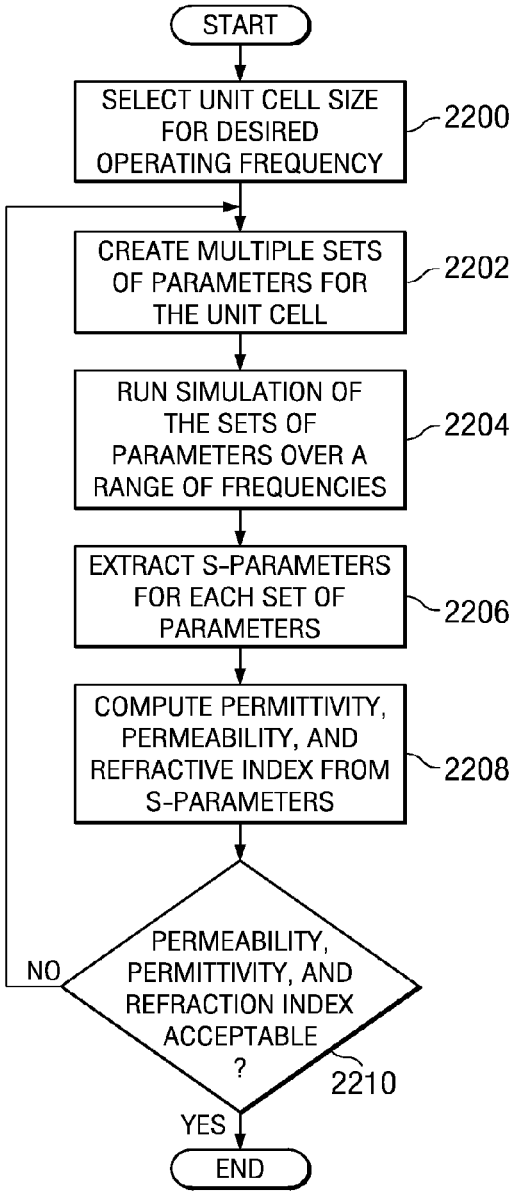
FIG. 22 is a flowchart of a process for designing negative index metamaterial unit cells in accordance with an advantageous embodiment.

With reference now to FIG. 22, a flowchart of a process for designing negative index metamaterial unit cells is depicted in accordance with an advantageous embodiment. The process illustrated in FIG. 22 is a more detailed explanation of operation 2012 in FIG. 20.

The process begins by selecting a unit cell size for the desired operating frequency (operation 2200). In this example, a fixed unit cell size of a 2.3 millimeter cube is selected for an operating frequency of around 15 GHz. In these examples, the unit cell is selected to be smaller than the wave length for effective medium theory to hold. Typical cell sizes may range from around $\lambda/5$ to around $\lambda/20$. Even smaller cell sizes may be used. In these examples, $\lambda$=free space wave length. Although smaller unit cell sizes may be better with respect to performance, these smaller sizes may become too small such that the split ring resonators and wire structures do not have sufficient inductance and capacitance to cause a negative index metamaterial effect.

The process then creates multiple sets of parameters for the unit cell (operation 2202). These parameters are any parameters that may affect the performance of the cell with respect to permittivity, permeability, and the refractive index. Examples of features that may be varied include, for example, without limitation, a width of copper traces for the split ring resonator, width of copper traces for a wire, the amount of separation between split ring resonators, the size of split in the split ring resonator, the size of gaps in the split ring resonator, and other suitable features.

Next, the process runs a simulation on the sets of parameters over a range of frequencies (operation 2204). The simulation performed in operation 2204 may be performed using the same software to perform the simulation of the runs in operation 2104 in FIG. 21. This simulation is a full wave simulation on the unit cell over a range of frequencies.

The process then extracts s-parameters for each set of parameters (operation 2206). In these examples, an s-parameter is also referred to as a scattering parameter. These parameters are used to describe the behavior of models undergoing various steady state stimuli by small signals. In other words, the scattering parameters are values or properties used to describe the behavior of a model, such as an electrical network, undergoing various steady state stimuli by small signals.

Thereafter, the process computes permittivity, permeability, and refractive index values for each of the sets of s-parameters extracted for the different sets of parameters (operation 2208). A determination is then made as to whether any of the permeability, permittivity, and refractive indices returned are acceptable (operation 2210). If one of these sets of values is acceptable, the process terminates. Otherwise, the process returns to operation 2202 to generate additional sets of parameters for the unit cell.

Figure 23:
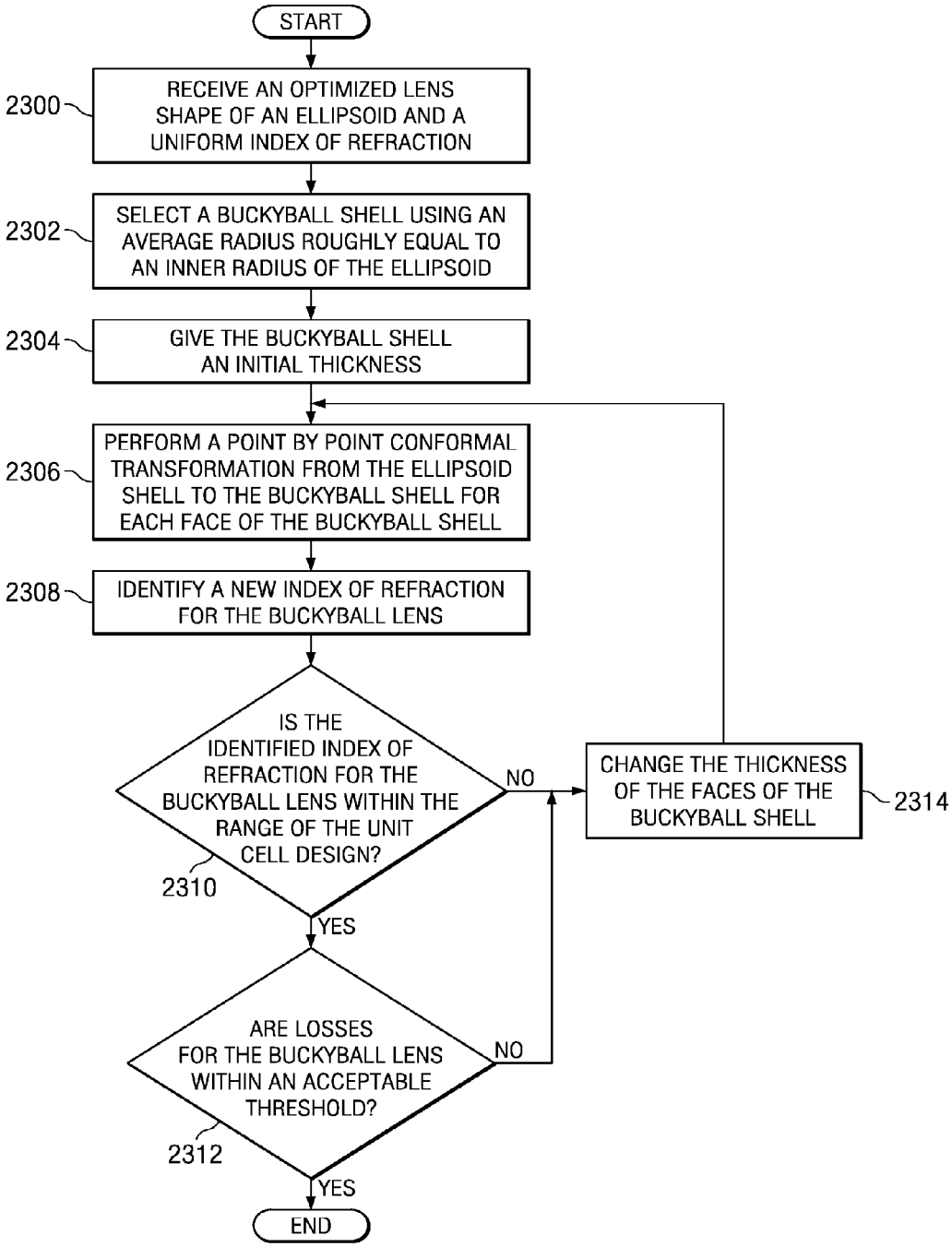
FIG. 23 is a flowchart of a process for generating a lens design in accordance with an advantageous embodiment.

With reference now to FIG. 23, a flowchart of a process for generating a lens design is depicted in accordance with an advantageous embodiment. The process illustrated in FIG. 23 may be used to generate a lens design having a shape of a truncated icosahedron or a buckyball. In these examples, the process illustrated in FIG. 23 may be performed using a data processing system, such as data processing system 1900 in FIG. 19.

The process may begin with results obtained from a lens designed in the shape of an ellipsoid. The process receives an optimized lens shape of an ellipsoid and a uniform index of refraction (operation 2300). A buckyball shell is selected using an average radius roughly equal to an inner radius of the ellipsoid (operation 2302). The buckyball shell is selected to fit within the optimized lens shape for the ellipsoid. In this illustrative example, the buckyball shell may not have the entire buckyball shape in the form of a sphere or ball. Instead, only a portion of the buckyball shape may be used for the buckyball shell.

The buckyball shell is given an initial thickness (operation 2304). In operation 2304, the initial thickness is the thickness of each face. This thickness may be an integer multiple of a thickness of a unit cell assembly. This initial thickness may be, for example, around six unit cells in the radial direction. The initial face thickness may be selected by choosing the thickness of a corresponding point on the ellipsoid, rounded to the nearest integer multiple.

A point by point conformal transformation from the ellipsoid shell to the buckyball shell is performed for each face of the buckyball shell (operation 2306). This operation provides a lens in the shape of the buckyball shell. A new index of refraction for the buckyball lens is identified (operation 2308). The index of refraction is identified for each point in which the conformal transformation has been performed in these examples. This operation may identify a number of different indices of refraction. Different points within different faces of the buckyball shell may have different indices of refraction in these illustrative examples.

The process then determines whether the identified index of refraction for the buckyball lens is within the range of the unit cell design (operation 2310). If the index of refraction is within the unit cell design range, a determination is made as to whether losses for the buckyball lens are within an acceptable threshold (operation 2312). If the losses are acceptable in operation 2312, the process terminates.

Otherwise, if the losses are not acceptable and/or the new index of refraction for the different points in the buckyball lens are not within the unit cell design range, the process changes the thickness of the faces of the buckyball shell (operation 2314), with the process then returning to operation 2306 as described above.

When the design of the buckyball lens is complete, this lens may be fabricated using discrete components and the identified unit cells. Also, in some advantageous embodiments, if the unit cells are not designed to accommodate or provide the index of refraction for the different points in the buckyball lens, the unit cells may be redesigned instead of changing the thickness by changing the number of unit cell assemblies that may be stacked on top of each other for the face.

The thickness of each face may be determined by the available unit cell design and corresponding refractive index range. In this illustrative example, the unit cell designs may have a range of index of refractions of around −1.9 to around −0.6. If, after the conformal transformation, the index required is smaller than around −1.9, the thickness of that face needs to be increased to achieve the same bending power, while requiring refractive indices within the acquired range. In this example, a smaller index may be around −2.5. On the other hand, if, after the conformal transformation, the index required is greater than around −0.6, the thickness may be reduced so the index of refraction falls within the acquired range. In this example, the thickness is the thickness of a unit cell assembly.

Figure 24:
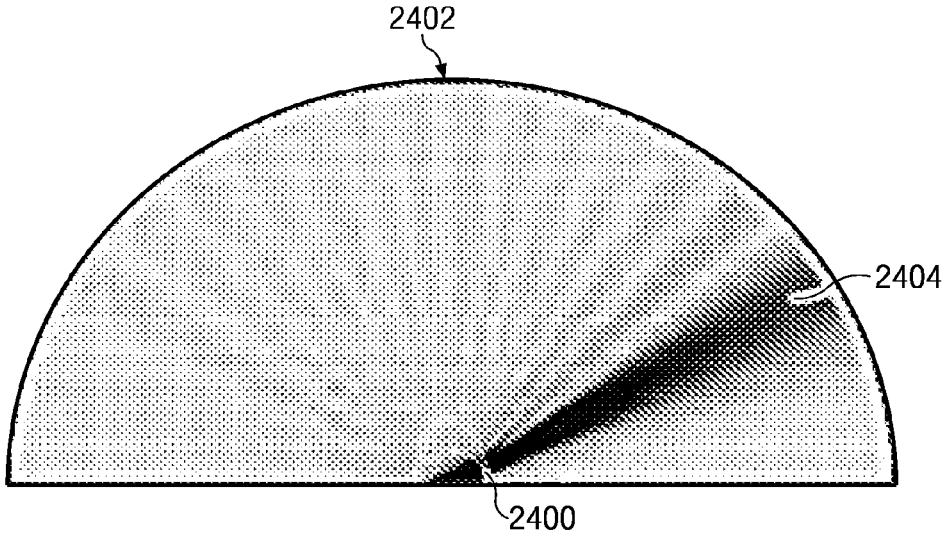
FIGS. 24, 25, and 26 are displays of beams in accordance with an advantageous embodiment.
Figure 25:
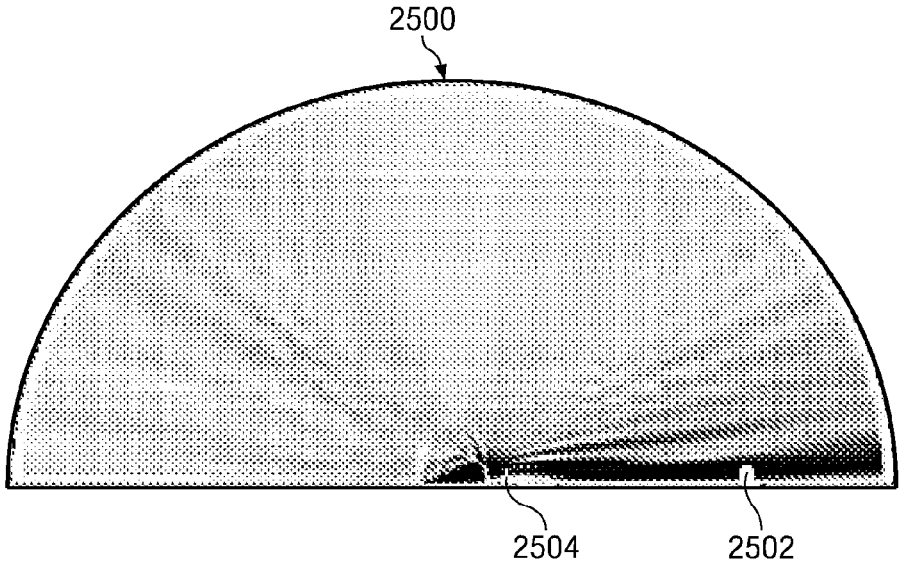
Figure 26:
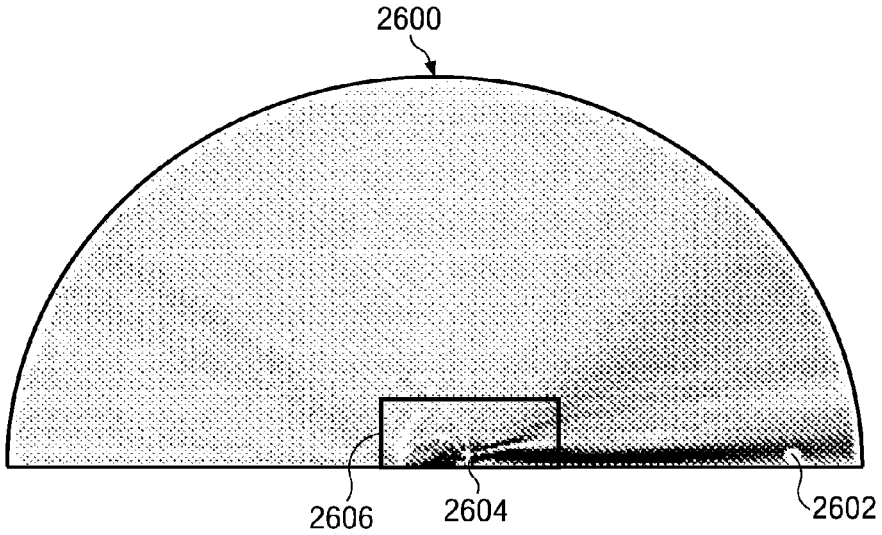

With reference now to FIGS. 24, 25, and 26, a display of beams is depicted in accordance with an advantageous embodiment. These figures illustrate results from simulations of beam transmission from an array. In FIG. 24, a beam is steered at around 60 degrees from a phased array located at point 2400 in display 2402. As can be seen, beam 2404 is around 60 degrees from vertical.

With reference now to FIG. 25, display 2500 illustrates the use of a smooth lens without discrete components. In this example, display 2500 illustrates the bending of beam 2502 to around a horizontal or 90 degree position from a phased array antenna meeting beam 2502 from point 2504.

With reference now to FIG. 26, a display of a beam bent by a lens is depicted in accordance with an advantageous embodiment. In this example, display 2600 illustrates beam 2602 being bent by a lens when projected by an array at around point 2604. Section 2606 is shown in greater detail in FIG. 27 below.

Figure 27:
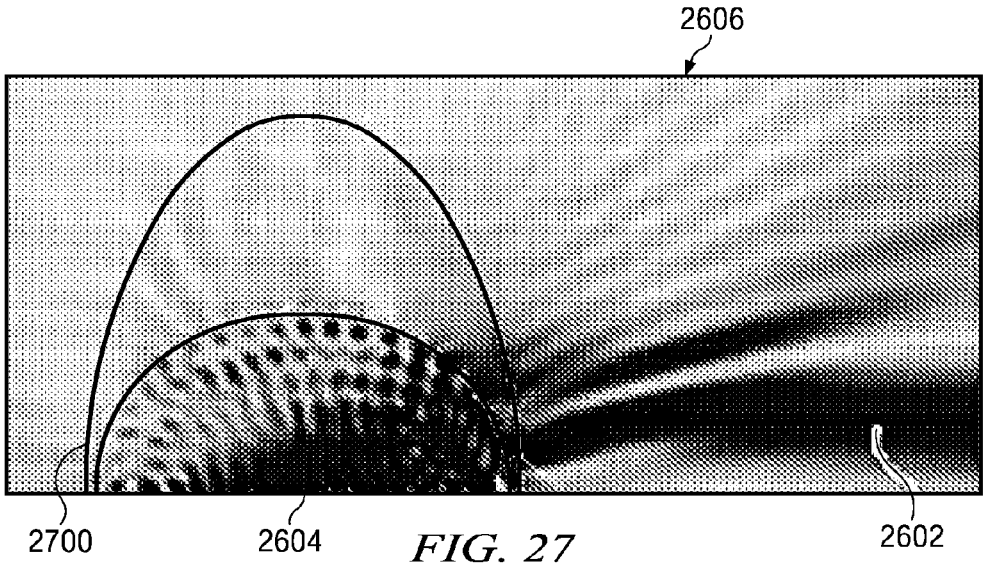
FIG. 27 is a magnified view of a section from FIG. 18 in accordance with an advantageous embodiment.

Turning now to FIG. 27, a magnified view of section 2606 from FIG. 26 is depicted in accordance with an advantageous embodiment. In this example, lens 2700 is shown bending beam 2602 to a direction that is around horizontal or around 90 degrees from a normal direction when emitting an array at point 2604.

Figure 28:
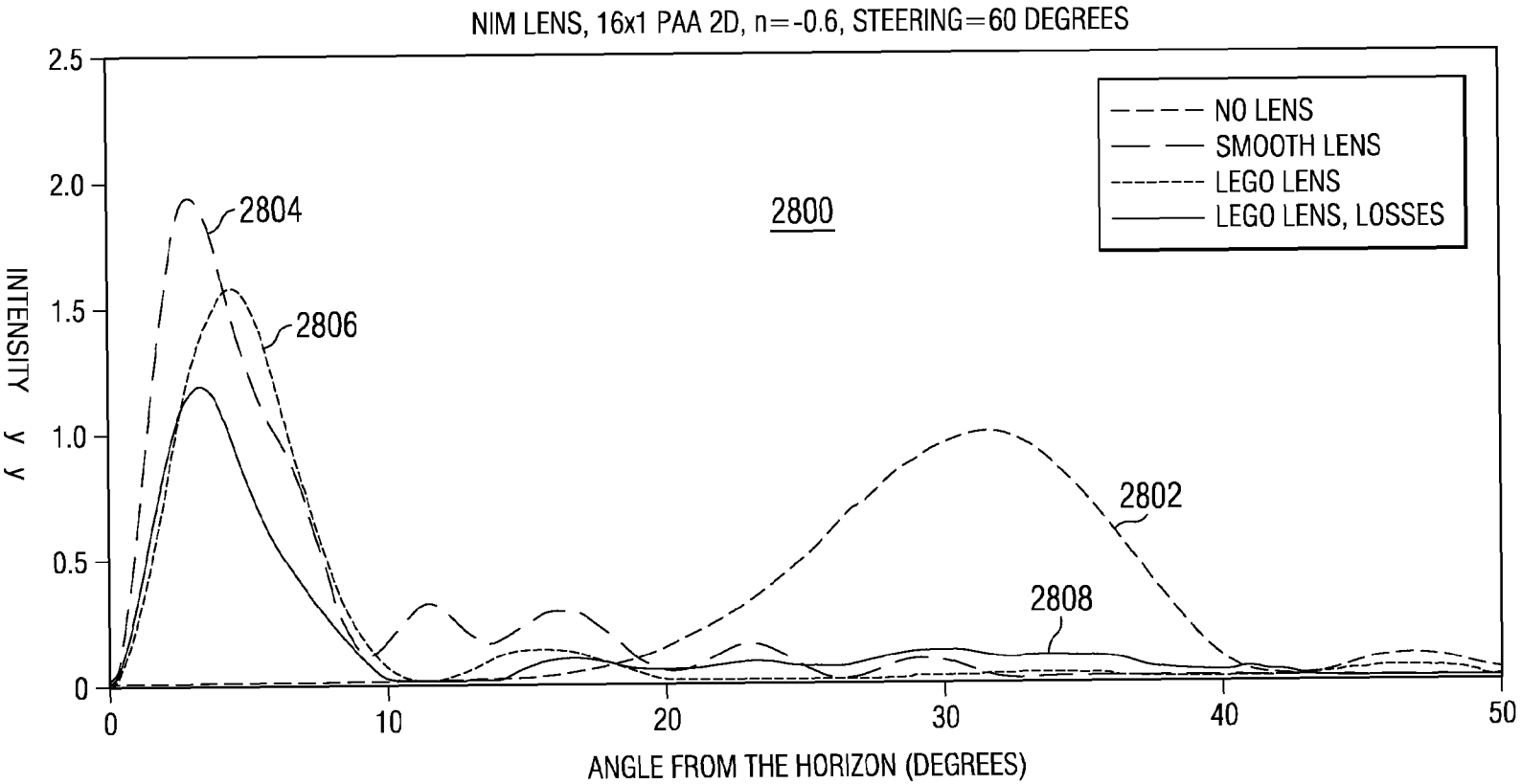
FIG. 28 is an intensity plot in accordance with an advantageous embodiment.

Turning now to FIG. 28, an intensity plot is depicted in accordance with an advantageous embodiment. In this example, plot 2800 contains lines indicating the intensity of a beam at different angles from horizontal. Line 2802 represents the intensity when no lens is used. As can be seen, the intensity of around 0 degrees from the horizon has no intensity while the greatest amount is around 30 degrees from the horizon.

In this example, 30 degrees represents a 60 degree from normal when steering is performed using a phased array. In this example, a 16×1 array is used. Line 2804 represents a smooth lens. Line 2806 represents a lens without losses, while line 2808 represents a lens with losses included in the simulation. As can be seen, the use of a lens increases the intensity at around 0 degrees with respect to the horizon. The intensity is greater with the smooth lens, however, the smooth lens does not represent actual construction of a lens for use with a phased array antenna.

Figure 29:
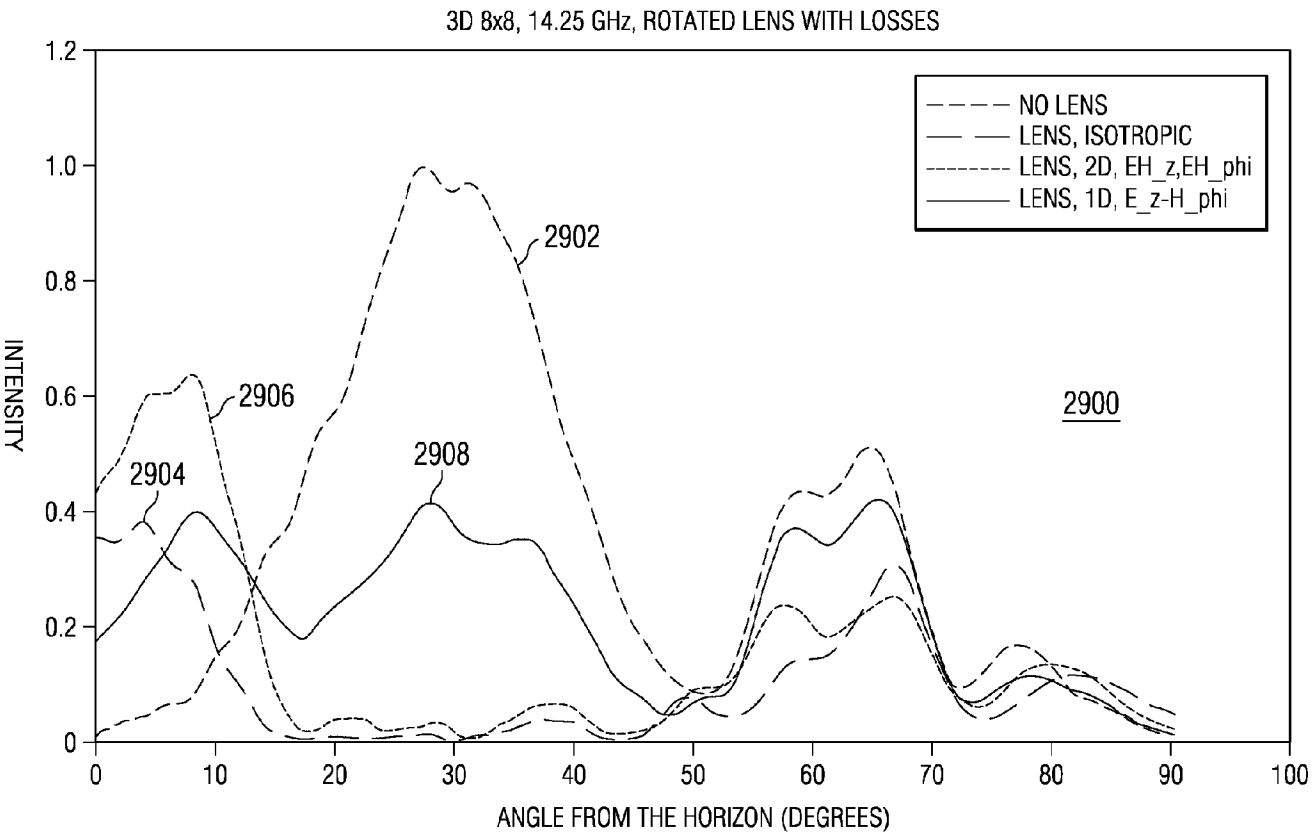
FIG. 29 is another intensity plot in accordance with an advantageous embodiment.

With reference now to FIG. 29, an intensity plot of a beam projected by a phased array antenna is depicted in accordance with an advantageous embodiment. In this example, plot 2900 represents results of a simulation performed with and without a negative index metamaterial lens in which a beam is steered at around 60 degrees.

The simulations in plot 2900 compare various levels of an isotropy in a lens. In plot 2900, line 2902 represents the intensity from different angles from horizontal when no lens is used. As can be seen, the intensity of line 2902 is low when the angle is around horizontal. Line 2904 illustrates the intensity for an isotropic lens. In this example, the refractive index is n equal to around −0.6 in all directions in space. In other words, the material is isotropic. The isotropic lens has a smaller intensity because more material losses occur in all directions. Line 2906 represents a lens made of reduced material having two dimensions.

In this example, a cylindrical coordinate system may be used in which the E and H field in the $\phi$ and z directions have a value of n equal to around −0.6 and n equal to around 1 in the r direction. Line 2908 represents another lens made of a one dimensional material. In other words, one component of the e field and h field has a negative index metamaterial component. In this example, the permittivity in the z direction is around −0.6 and equals one in the $\phi$ and r directions. The amount of permeability equals around −0.6 in the $\phi$ direction and equals one in the r and z direction in a cylindrical coordinate system.

Thus, the different advantageous embodiments provide a new application for a negative index metamaterial lens for steering beams projected or emitted by a phased array antenna. In the different advantageous embodiments, the negative index metamaterial lenses enhance the scanning angle of phased array antennas. In the different advantageous embodiments, unit cell designs are used to form the negative index metamaterial lenses. Although particular cell designs are presented in the different illustrations, any cell design may be used that achieves the desired properties when a beam is passed through the lens.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a negative index metamaterial lens having a buckyball shape that is capable of bending a radio frequency beam to a selected angle relative to a normal vector, the lens comprising a plurality of discrete components; and an array capable of emitting the radio frequency beam.

2. The apparatus of claim 1, wherein the plurality of discrete components comprises a plurality of negative index metamaterial unit cells arranged in a configuration.

3. The apparatus of claim 2, wherein a metamaterial unit cell in the plurality of metamaterial unit cells comprises a first trace and a second trace symmetric about a center line.

4. The apparatus of claim 3, wherein the first trace and the second trace have substantially the same pattern and the second trace is rotated 180 degrees with respect to the first trace around a normal axis.

5. The apparatus of claim 1, wherein the buckyball shape for the negative index metamaterial lens is configured to bend a beam generated by the phased array antenna to around 90 degrees from a vertical orientation to form an initial design.

6. The apparatus of claim 1, wherein the buckyball shape comprises a shell having a radius that substantially comprises an average radius of an inner radius and an outer radius of a lens design, wherein the shell comprises a plurality of faces, and wherein the plurality of faces have a plurality of points.

7. The apparatus of claim 6, wherein a face in the plurality of faces includes a number of points derived from a conformal transformation from of a set of points in a lens design.

8. A phased array antenna comprising:

a negative index metamaterial lens having a shell substantially in a shape of a truncated icosahedron, the lens configured to bend a radio frequency beam from a first angle to a second angle different from the first angle, relative to a normal vector, the lens comprising a plurality of discrete components; and an array capable of emitting the radio frequency beam, the lens positioned over the array.

9. The phased array antenna of claim 8, wherein the plurality of discrete components comprises a plurality of negative index metamaterial unit cells.

10. The phased array antenna of claim 9, wherein a metamaterial unit cell in the plurality of negative index metamaterial unit cells comprises a first trace and a second trace symmetric about a center line.

11. The phased array antenna of claim 10, wherein the first trace and the second trace have substantially the same pattern and the second trace is rotated 180 degrees with respect to the first trace around a normal axis.

12. The phased array antenna of claim 9, wherein a set of unit cells in the plurality of unit cells comprises a split ring resonator.

13. The phased array antenna of claim 8, wherein the plurality of discrete components is configured in a crystalline structure.

14. The phased array antenna of claim 8, wherein the buckyball shape comprises a shell having substantially an average radius of an inner radius and an outer radius of a lens design, and the shell comprises a plurality of faces, each face having plurality of points.

15. The phased array antenna of claim 14, wherein a face in the plurality of faces includes a number of points derived from a conformal transformation from of a set of points in the lens design.

16. A phased array antenna comprising:

a negative index metamaterial lens having a shell substantially in a shape of a truncated icosahedron, the lens configured to bend a radio frequency beam from a first angle to a second angle different from the first angle, relative to a normal vector, the lens comprising a plurality of discrete components, the plurality of discrete components comprising a number of metamaterial unit cells, and the shell is characterized by a radius substantially comprising an average radius of an inner radius and an outer radius of a lens design, and a face in the lens defined by a number of points determined from a conformal transformation of a set of points in the lens design; and an array capable of emitting the radio frequency beam, the lens positioned over the array.

17. The phased array antenna of claim 16, wherein a metamaterial unit cell in the plurality of negative index metamaterial unit cells comprises a first trace and a second trace symmetric about a center line.

18. The phased array antenna of claim 17, wherein the first trace and the second trace have substantially the same pattern and the second trace is rotated 180 degrees with respect to the first trace around a normal axis.

19. The phased array antenna of claim 16, wherein a set of unit cells in the number of unit cells comprises a split ring resonator.

20. The phased array antenna of claim 16, wherein the inner radius is taken from an inner ellipse and the outer radius is taken from an outer ellipse of the lens design.

* * * * *